US007532834B2

(12) United States Patent
Kagawa et al.

(10) Patent No.: US 7,532,834 B2
(45) Date of Patent: May 12, 2009

(54) FIXING DEVICE AND FIXING METHOD AND IMAGE FORMING DEVICE

(75) Inventors: Toshiaki Kagawa, Nara (JP); Hiroshi Kida, Yamatokoriyama (JP); Takashi Yamanaka, Yamatokoriyama (JP); Tetsunori Mitsuoka, Tondabayashi (JP)

(73) Assignee: Sharp Kabushiki Kaisha, Osaka (JP)

( * ) Notice: Subject to any disclaimer, the term of this patent is extended or adjusted under 35 U.S.C. 154(b) by 400 days.

(21) Appl. No.: 10/571,939

(22) PCT Filed: Sep. 15, 2004

(86) PCT No.: PCT/JP2004/013440

§ 371 (c)(1),
(2), (4) Date: Mar. 15, 2006

(87) PCT Pub. No.: WO2005/029199

PCT Pub. Date: Mar. 31, 2005

(65) Prior Publication Data

US 2007/0036571 A1 Feb. 15, 2007

(30) Foreign Application Priority Data

Sep. 16, 2003 (JP) ..... 2003-323293

(51) Int. Cl.
*G03G 15/20* (2006.01)

(52) U.S. Cl. ..... 399/69; 219/216

(58) Field of Classification Search ..... 399/69, 399/328, 330, 331; 219/216, 469–471
See application file for complete search history.

(56) References Cited

U.S. PATENT DOCUMENTS 5,204,716 A * 4/1993 Kasahara et al.

(Continued)

FOREIGN PATENT DOCUMENTS

JP 48-38733 A 7/1973

(Continued)

OTHER PUBLICATIONS

Tetsunori Mitsuoka et al., "Development of High-speed and Low-energy Fusing System", Electronic Imaging & Devices Research Laboratory, Japan Hardcopy 2004, Fall, pp. 29-32, announced on Nov. 26, 2004.

*Primary Examiner*—Susan S Lee
(74) *Attorney, Agent, or Firm*—Birch, Stewart, Kolasch & Birch, LLP

(57) ABSTRACT

A fixing device (23) of the present invention includes a fixing roller (131) contacting a toner image surface, and a pressure roller (132) contacting a surface opposite to the toner image surface. In the fixing device (23), a printing sheet (P) on which unfixed toner image is formed passes through a fixing nip portion (Y) where the fixing roller (131) and the pressure roller (132) are in contact with each other, so that the above-described toner image is fixed on the printing sheet (P). The fixing device (23) further includes a control circuit (150) which controls heater lamps (134 to 136) so that a surface temperature of the pressure roller (132) is in a temperature range defined by a cold offset occurring boundary temperature (Thc) of the fixing roller (131) and/or a hot offset occurring boundary temperature (Thh) of the fixing roller (131). With this, it is possible to suppress or prevent a transfer of toner to a pair of rollers (a transfer from the back of the printing sheet to the pressure roller, a transfer from the pressure roller to the fixing roller).

22 Claims, 24 Drawing Sheets

U.S. PATENT DOCUMENTS

| | | | | |
|---|---|---|---|---|
| 7,054,589 | B2 * | 5/2006 | Okayasu et al. | |
| 2003/0123892 | A1 * | 7/2003 | Kobayashi | 399/69 |
| 2003/0170055 | A1 * | 9/2003 | Terada et al. | 399/328 |
| 2003/0202827 | A1 * | 10/2003 | Samei et al. | |
| 2004/0037596 | A1 * | 2/2004 | Nakamura et al. | 399/328 |

FOREIGN PATENT DOCUMENTS

| | | | | |
|---|---|---|---|---|
| JP | 59-72464 | A | | 4/1984 |
| JP | 8-129313 | A | | 5/1996 |
| JP | 8-220929 | A | | 8/1996 |
| JP | 09325643 | A | * | 12/1997 |
| JP | 11-95601 | A | | 4/1999 |
| JP | 2000-181277 | A | | 6/2000 |
| JP | 2001117401 | A | * | 4/2001 |
| JP | 2003-162171 | A | | 6/2003 |

* cited by examiner

FIG. 2 (a) DEVICE 1

| TEMPERATURE (°C) OF FIXING ROLLER | TEMPERATURE (°C) OF EXTERNAL HEATING ROLLER | TEMPERATURE (°C) OF PRESSURE ROLLER | TONER CONTAMINATION |
|---|---|---|---|
| 200 | OFF | 99 | × |
| 200 | 120 | 121 | × |
| 200 | 140 | 126 | △ |
| 200 | 150 | 130 | ○ |
| 200 | 160 | 132 | ○ |
| 200 | 170 | 134 | ○ |
| 200 | 180 | 136 | ○ |

× : TONER CONTAMINATION CAN BE SEEN OBVIOUSLY

△ : TONER CONTAMINATION CAN BE SEEN SLIGHTLY

○ : TONER CONTAMINATION CAN HARDLY BE SEEN

FIG. 2 (b) DEVICE 2

| TEMPERATURE (°C) OF FIXING ROLLER | TEMPERATURE (°C) OF EXTERNAL HEATING ROLLER | TEMPERATURE (°C) OF PRESSURE ROLLER | TONER CONTAMINATION |
|---|---|---|---|
| 200 | OFF | 102 | × |
| 200 | 110 | 124 | × |
| 200 | 130 | 129 | △ |
| 200 | 140 | 132 | ○ |
| 200 | 150 | 134 | ○ |
| 200 | 160 | 136 | ○ |
| 200 | 170 | 138 | ○ |

× : TONER CONTAMINATION CAN BE SEEN OBVIOUSLY

△ : TONER CONTAMINATION CAN BE SEEN SLIGHTLY

○ : TONER CONTAMINATION CAN HARDLY BE SEEN

FIG. 2 (c) DEVICE 3

| TEMPERATURE (°C) OF FIXING ROLLER | TEMPERATURE (°C) OF EXTERNAL HEATING ROLLER | TEMPERATURE (°C) OF PRESSURE ROLLER | TONER CONTAMINATION |
|---|---|---|---|
| 200 | OFF | 105 | × |
| 200 | 100 | 127 | △ |
| 200 | 120 | 130 | ○ |
| 200 | 130 | 133 | ○ |
| 200 | 140 | 135 | ○ |
| 200 | 150 | 138 | ○ |
| 200 | 160 | 141 | ○ |

× : TONER CONTAMINATION CAN BE SEEN OBVIOUSLY

△ : TONER CONTAMINATION CAN BE SEEN SLIGHTLY

○ : TONER CONTAMINATION CAN HARDLY BE SEEN

FIG. 3 (a)DEVICE 1
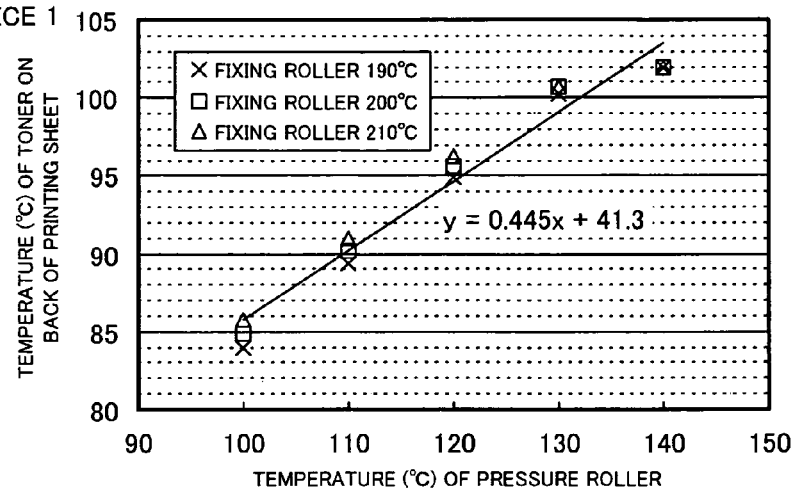
FIG. 3 (b)DEVICE 2
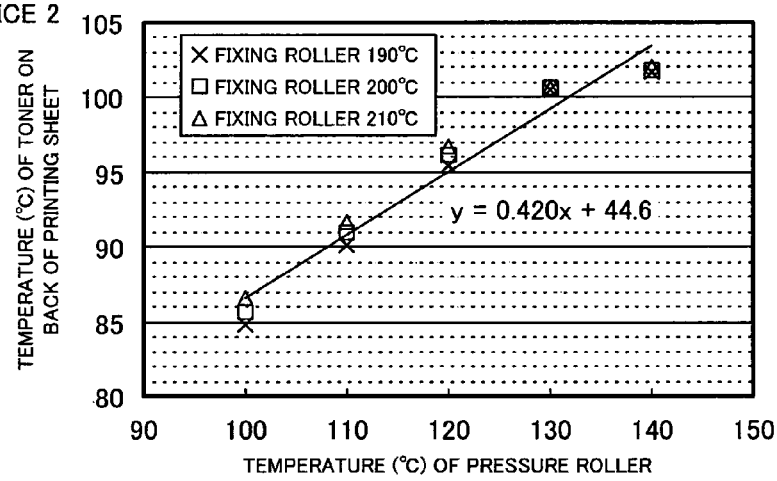
FIG. 3 (c)DEVICE 3
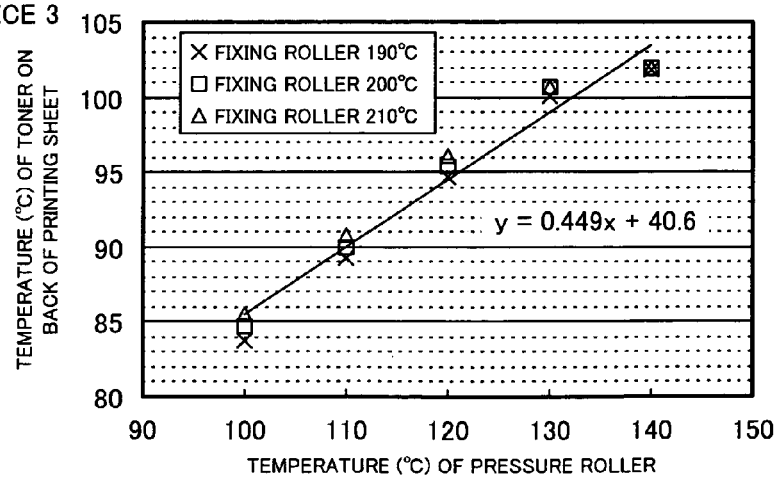

FIG. 5 (a) DEVICE 1

| TEMPERATURE (°C) OF FIXING ROLLER | 110 | 120 | 130 | 140 | 150 | 160 | 170 | 180 | 190 | 200 |
|---|---|---|---|---|---|---|---|---|---|---|
| TEMPERATURE (°C) OF PRESSURE ROLLER | 100 | 110 | 120 | 130 | 140 | 150 | 160 | 170 | 178 | 185 |
| COLD OFFSET | × | × | ○ | ○ | ○ | ○ | ○ | ○ | ○ | ○ |

○: NOT OCCURRED ×: OCCURRED

FIG. 5 (b) DEVICE 2

| TEMPERATURE (°C) OF FIXING ROLLER | 110 | 120 | 130 | 140 | 150 | 160 | 170 | 180 | 190 | 200 |
|---|---|---|---|---|---|---|---|---|---|---|
| TEMPERATURE (°C) OF PRESSURE ROLLER | 100 | 110 | 120 | 130 | 140 | 150 | 160 | 170 | 178 | 185 |
| COLD OFFSET | × | × | ○ | ○ | ○ | ○ | ○ | ○ | ○ | ○ |

○: NOT OCCURRED ×: OCCURRED

FIG. 5 (c) DEVICE 3

| TEMPERATURE (°C) OF FIXING ROLLER | 110 | 120 | 130 | 140 | 150 | 160 | 170 | 180 | 190 | 200 |
|---|---|---|---|---|---|---|---|---|---|---|
| TEMPERATURE (°C) OF PRESSURE ROLLER | 100 | 110 | 120 | 130 | 140 | 150 | 160 | 170 | 178 | 185 |
| COLD OFFSET | × | × | ○ | ○ | ○ | ○ | ○ | ○ | ○ | ○ |

○: NOT OCCURRED ×: OCCURRED

FIG. 6 (a) DEVICE 1
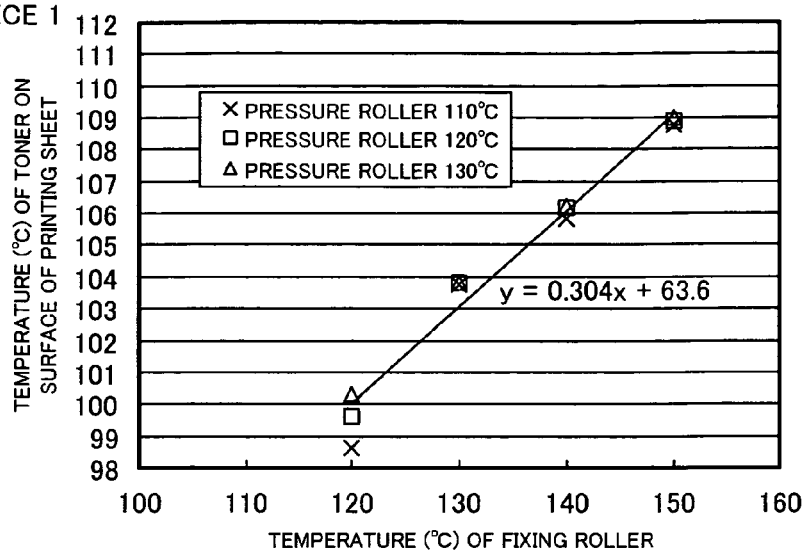
FIG. 6 (b) DEVICE 2
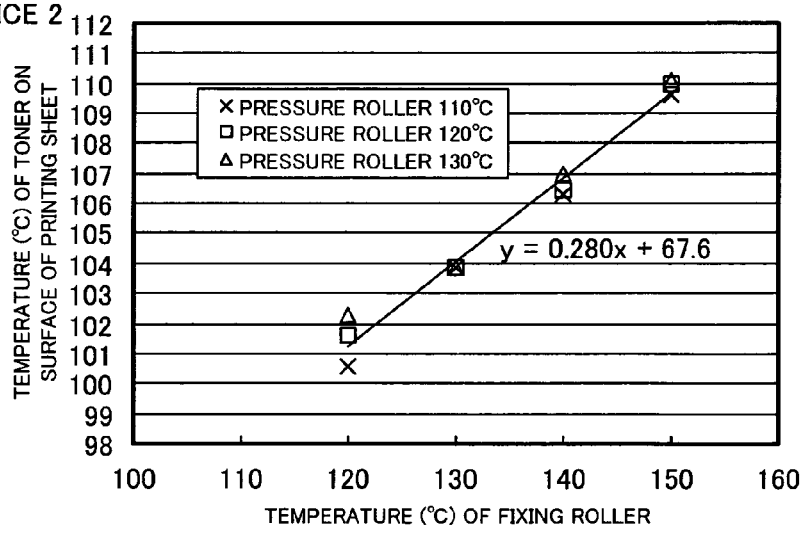
FIG. 6 (c) DEVICE 3
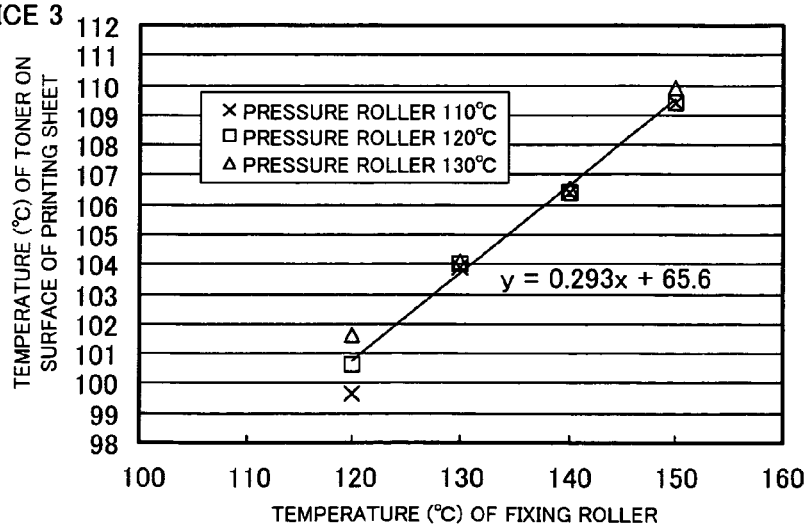

FIG. 8 (a)DEVICE 1

| TEMPERATURE Th (°C) OF FIXING ROLLER | TEMPERATURE Tp (°C) OF PRESSURE ROLLER | TEMPERATURE Tt3 (°C) OF TONER |
|---|---|---|
| 190 | 190 | 189.7 |
| 200 | 180 | 191.3 |
| 210 | 170 | 193.0 |

FIG. 8 (b)DEVICE 2

| TEMPERATURE Th (°C) OF FIXING ROLLER | TEMPERATURE Tp (°C) OF PRESSURE ROLLER | TEMPERATURE Tt3 (°C) OF TONER |
|---|---|---|
| 190 | 190 | 189.5 |
| 200 | 180 | 191.8 |
| 210 | 170 | 194.1 |

FIG. 8 (c)DEVICE 3

| TEMPERATURE Th (°C) OF FIXING ROLLER | TEMPERATURE Tp (°C) OF PRESSURE ROLLER | TEMPERATURE Tt3 (°C) OF TONER |
|---|---|---|
| 190 | 190 | 189.5 |
| 200 | 180 | 191.5 |
| 210 | 170 | 193.5 |

FIG. 9 (a) DEVICE 1

| TEMPERATURE (°C) OF FIXING ROLLER | 220 | 230 | 240 | 250 | 260 |
|---|---|---|---|---|---|
| TEMPERATURE (°C) OF PRESSURE ROLLER | 210 | 215 | 220 | 225 | 230 |
| HOT OFFSET | ○ | ○ | ○ | × | × |
| TEMPERATURE (°C) OF TONER ON SURFACE OF PRINTING SHEET | 168.6 | 176.5 | 184.2 | 191.9 | 199.4 |

○ : NOT OCCURRED × : OCCURRED

FIG. 9 (b) DEVICE 2

| TEMPERATURE (°C) OF FIXING ROLLER | 220 | 230 | 240 | 250 | 260 |
|---|---|---|---|---|---|
| TEMPERATURE (°C) OF PRESSURE ROLLER | 210 | 215 | 220 | 225 | 230 |
| HOT OFFSET | ○ | ○ | ○ | × | × |
| TEMPERATURE (°C) OF TONER ON SURFACE OF PRINTING SHEET | 173.1 | 180.9 | 188.6 | 196.2 | 203.8 |

○ : NOT OCCURRED × : OCCURRED

FIG. 9 (c) DEVICE 3

| TEMPERATURE (°C) OF FIXING ROLLER | 220 | 230 | 240 | 250 | 260 |
|---|---|---|---|---|---|
| TEMPERATURE (°C) OF PRESSURE ROLLER | 210 | 215 | 220 | 225 | 230 |
| HOT OFFSET | ○ | ○ | ○ | × | × |
| TEMPERATURE (°C) OF TONER ON SURFACE OF PRINTING SHEET | 170.7 | 178.6 | 186.4 | 194.2 | 201.8 |

○ : NOT OCCURRED × : OCCURRED

FIG. 10 (a) DEVICE 1
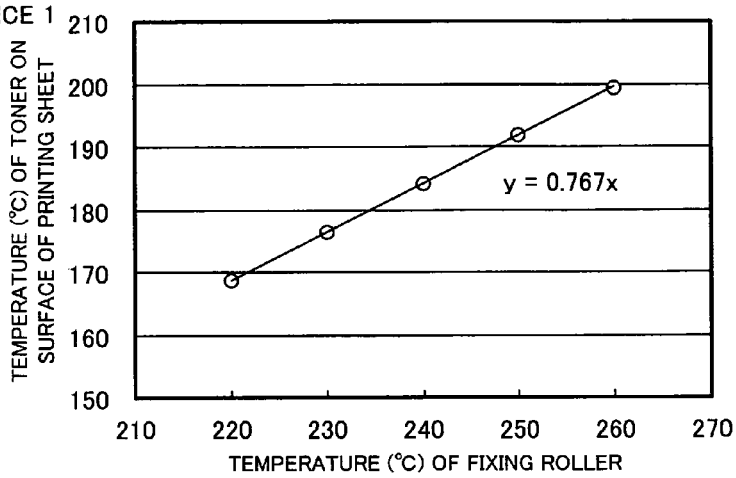
FIG. 10 (b) DEVICE 2
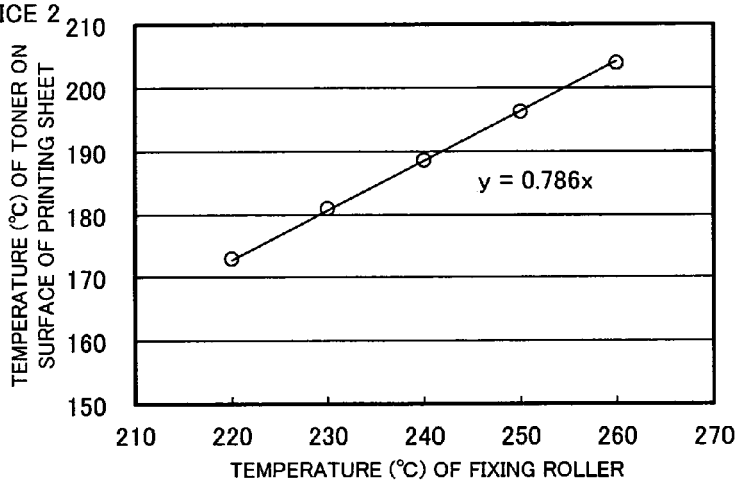
FIG. 10 (c) DEVICE 3
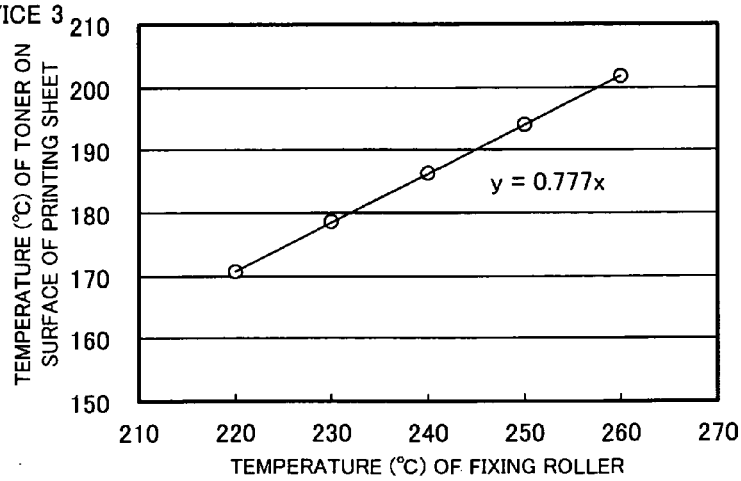

FIG. 12 (a)

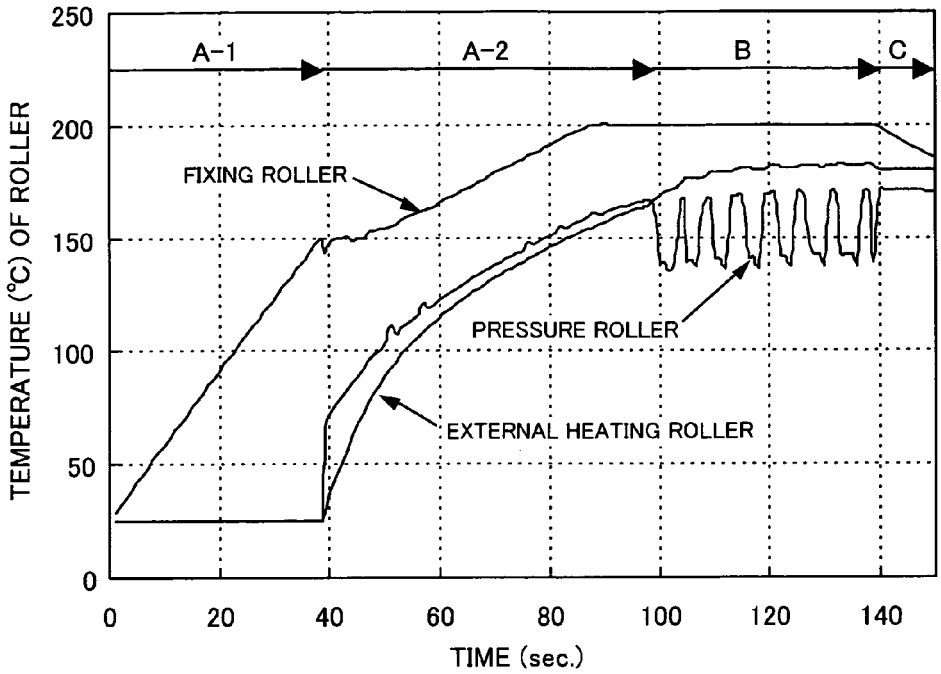

FIG. 12 (b)

| | A-1 | A-2 | B | C |
|---|---|---|---|---|
| | WARM UP (1) | WARM UP (2) | FEEDING | POST-ROTATION |
| ROTATION | STOPPED | ROTATED | ROTATED | ROTATED |
| HEAT SOURCE OF FIXING ROLLER | ON | ON | ON | OFF |
| ELECTRIC POWER OF HEAT SOURCE OF FIXING ROLLER | 950W | 950W | 650W | 0W |
| CONTROL TEMPERATURE OF FIXING ROLLER | 150°C | 200°C | 200°C | — |
| HEAT SOURCE OF EXTERNAL HEATING ROLLER | OFF | OFF | ON | ON |
| ELECTRIC POWER OF HEAT SOURCE OF EXTERNAL HEATING ROLLER | 0W | 0W | 200W | 200W |
| CONTROL TEMPERATURE OF EXTERNAL HEATING ROLLER | — | — | 200°C | 180°C |

FIG. 13 (a) EMBODIMENT
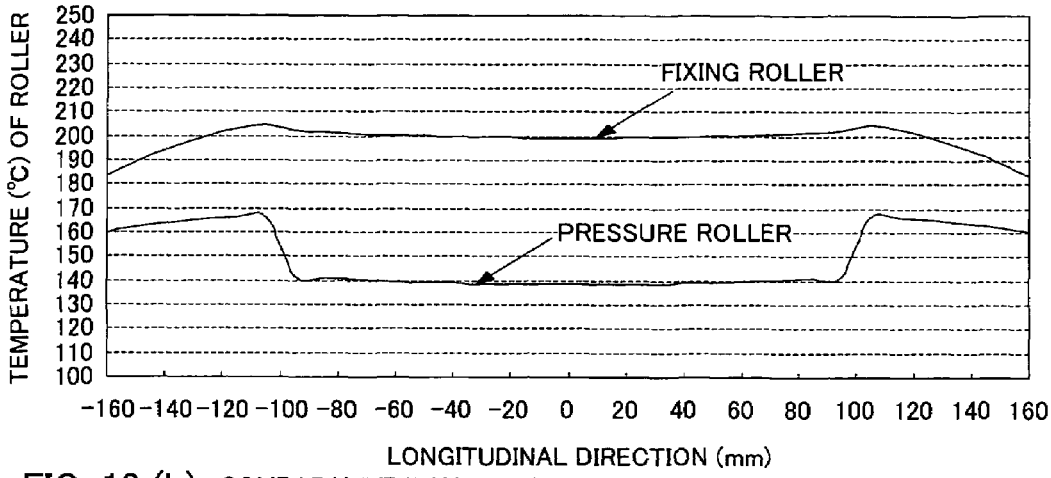
FIG. 13 (b) COMPARATIVE EXAMPLE 1
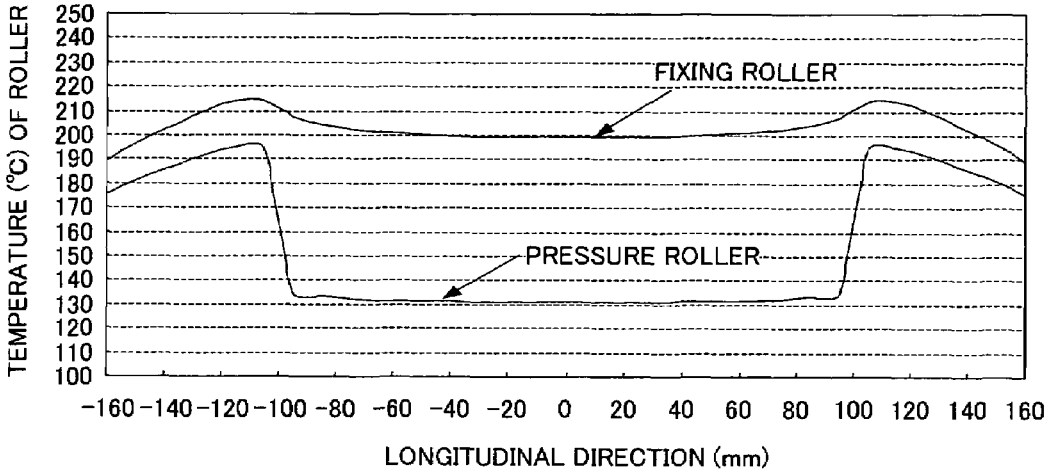
FIG. 13 (c) COMPARATIVE EXAMPLE 2
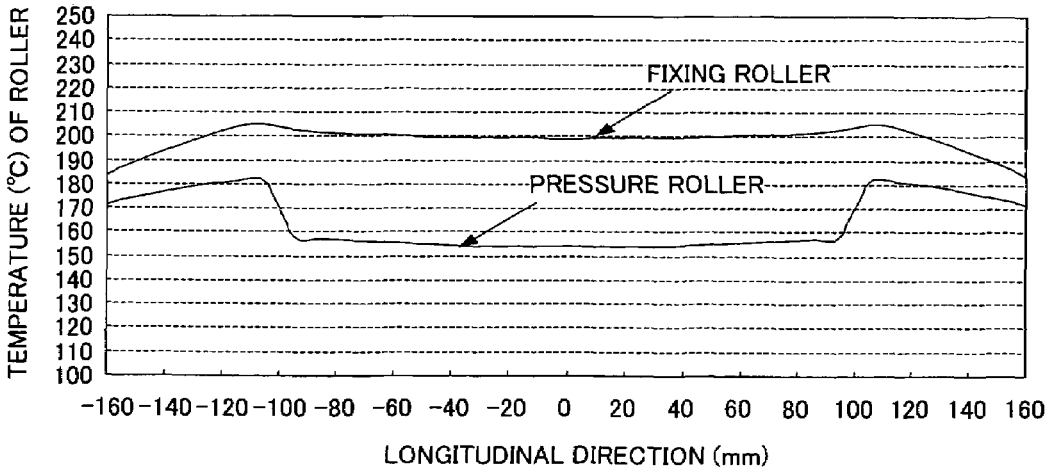

FIG. 14

| | COMPARATIVE EXAMPLE X | | COMPARATIVE EXAMPLE Y | | EMBODIMENT | |
|---|---|---|---|---|---|---|
| EXTERNAL HEATING ROLLER | NOT PROVIDED | | PROVIDED | | PROVIDED | |
| CLEANING ROLLER | NOT PROVIDED | | PROVIDED | | PROVIDED | |
| HEAT SOURCE OF EXTERNAL HEATING ROLLER | — | | ON | | OFF | |
| TEMPERATURE OF EXTERNAL HEATING ROLLER | — | | 200°C | | 150°C | |
| | SHEET-CONTACTING PORTION | NO-SHEET-CONTACTING PORTION | SHEET-CONTACTING PORTION | NO-SHEET-CONTACTING PORTION | SHEET-CONTACTING PORTION | NO-SHEET-CONTACTING PORTION |
| TEMPERATURE Th OF FIXING ROLLER | 200°C | 214°C | 200°C | 205.3°C | 200°C | 204.5°C |
| PRESSURE ROLLER TEMPERATURE AT WHICH OFFSET DOES NOT OCCUR | ≧137°C | ≦166.2°C | ≧137°C | ≦174.9°C | ≧137°C | ≦175.4°C |
| TEMPERATURE Tp OF PRESSURE ROLLER | 131.2 | 194.8 | 153.9 | 181.1 | 138.3 | 166.3 |
| OFFSET | OCCURRED | OCCURRED | NOT OCCURRED | OCCURRED | NOT OCCURRED | NOT OCCURRED |

FIG. 15

| | DEVICE 1 | DEVICE 2 | DEVICE 3 |
|---|---|---|---|
| FIXING SPEED | 365mm/s | 225mm/s | 122mm/s |
| DIAMETER OF FIXING ROLLER | φ40 | φ35 | φ25 |
| MATERIAL OF CORE BAR OF FIXING ROLLER | STKM | STKM | ALUMINUM |
| THICKNESS OF CORE BAR OF FIXING ROLLER | 1.3mm | 0.4mm | 1mm |
| DIAMETER OF PRESSURE ROLLER | φ40 | φ35 | φ25 |
| RUBBER LAYER OF PRESSURE ROLLER | SILICON SOLID | SILICON SPONGE | SILICON SPONGE |
| WIDTH OF FIXING NIP | 6mm | 4mm | 2mm |

FIG. 25 (a)

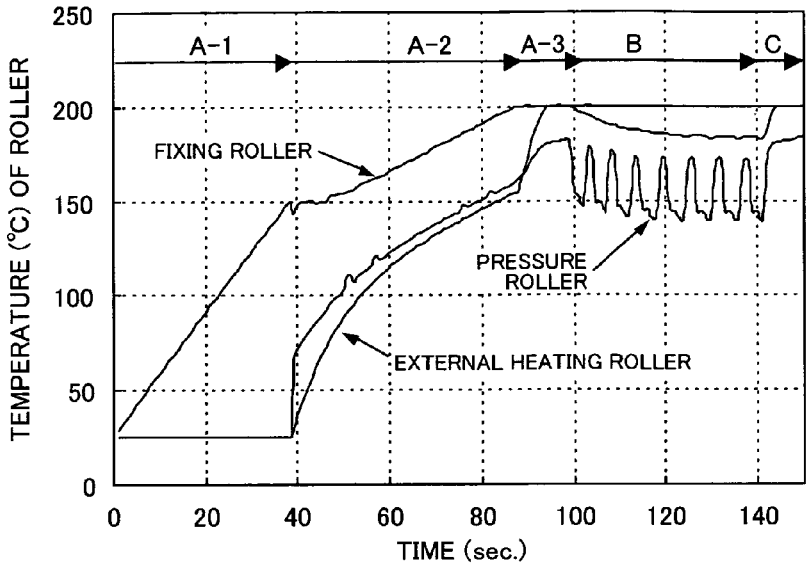

FIG. 25 (b)

| | A-1 | A-2 | A-3 | B | C |
|---|---|---|---|---|---|
| | WARM UP (1) | WARM UP (2) | WARM UP (3) | FEEDING | POST-ROTATION |
| ROTATION | STOPPED | ROTATED | ROTATED | ROTATED | ROTATED |
| HEAT SOURCE OF FIXING ROLLER | ON | ON | ON | ON | ON |
| ELECTRIC POWER OF HEAT SOURCE OF FIXING ROLLER | 950W | 950W | 650W | 650W | 650W |
| CONTROL TEMPERATURE OF FIXING ROLLER | 150°C | 200°C | 200°C | 200°C | 200°C |
| HEAT SOURCE OF EXTERNAL HEATING ROLLER | OFF | OFF | ON | ON | ON |
| ELECTRIC POWER OF HEAT SOURCE OF EXTERNAL HEATING ROLLER | 0W | 0W | 200W | 200W | 200W |
| CONTROL TEMPERATURE OF EXTERNAL HEATING ROLLER | — | — | 200°C | 200°C | 200°C |

FIXING DEVICE AND FIXING METHOD AND IMAGE FORMING DEVICE

TECHNICAL FIELD

The present invention relates to a fixing device and fixing method in, for example, a dry electrophotographic device.

BACKGROUND ART

A fixing device is one typical heating device used in an electrophotographic device, such as a copier or a printer, and the fixing device usually includes a pair of rollers (a fixing roller and a pressure roller) that are in contact with each other. The fixing device employs, as a fixing method, a heat roller fixing method which fixes an unfixed toner image by heat and pressure in the following procedure: first, the fixing roller is heated to a predetermined temperature (fixing temperature) by heating means, such as a halogen heater, placed inside the fixing roller which contacts a toner image surface; second, a printing sheet on which the unfixed toner image is formed is caused to pass through a contacting portion (a fixing nip portion) where the fixing roller and the pressure roller are in contact with each other.

In such fixing device, since a phenomenon in which some melted toner adhere to the fixing roller occurs, a cleaning roller is usually provided for removing the toner adhered to the fixing roller.

Incidentally, to remove the toner adhered to the fixing roller, the cleaning roller is provided so as to directly contact the fixing roller. Therefore, since the increase of the surface temperature of the fixing roller causes the increase of the surface temperature of the cleaning roller, the toner removed from the surface of the fixing roller melts again on the surface of the cleaning roller. As a result, the following problem occurs: since the toner adheres to the surface of the cleaning roller, it is not possible to sufficiently carry out the cleaning of the surface of the fixing roller.

In addition to this, the following problem also occurs: since the cleaning roller directly contacts the fixing roller, the heat of the fixing roller is transferred to the cleaning roller when the fixing roller is increased in temperature, so that the amount of heat to be applied to the fixing roller is increased, the power consumption is increased, and the warm-up time becomes long.

Here, to reduce the heat load of the fixing roller and the power consumption, conventionally suggested is a configuration in which the toner adhered to the fixing roller is transferred to the pressure roller having the lower temperature than the fixing roller, and the toner on the pressure roller is collected by the cleaning roller provided in direct contact with the pressure roller (for example, see Japanese Unexamined Patent Publication No. 162171/2003(Tokukai 2003-162171), published on Jun. 6, 2003)).

However, according to this configuration, cleaning means is provided only for the pressure roller. Therefore, the cleaning means is terribly contaminated by the toner, the life of the cleaning means is short, and the cleaning means needs to be replaced frequently. Thus, there is a problem in that the maintenance of this configuration is difficult.

In addition, there is a problem in that the toner remained since the cleaning means cannot clean completely is transferred again from the pressure roller to the fixing roller, and the toner contaminates the image surface of the printing sheet.

Especially, in an image forming apparatus including contact-type transfer means, such as a transfer roller or a transfer belt, when sheets are fed continuously, the transfer means is contaminated by the fogging toner on a photoreceptor because of an interval between the sheets. As a result, the fogging toner adheres to the back of the sheet, and the pressure roller of the fixing device provided downstream of the transfer means is contaminated terribly.

DISCLOSURE OF INVENTION

An object of the present invention is to provide a fixing device which is less likely to contaminate a printing sheet by toner and excels in maintenance by reducing or preventing unnecessary toner transfer (a transfer from the back of a printing sheet to a pressure roller, a transfer from a pressure roller to a fixing roller).

To achieve the above-described object, a fixing device of the present invention includes a first contacting member contacting a toner image surface and a second contacting member contacting a surface opposite to the toner image surface, and the fixing device fixes an unfixed toner image on a printing medium by causing the printing medium to pass through a contacting region (i) where the first contacting member and the second contacting member are in contact with each other and (ii) which is heated to a temperature at which fixing of toner is able to be carried out. Moreover, the fixing device of the present invention further includes: heating means for heating the first contacting member and the second contacting member; and control means for controlling the heating means so that a surface temperature of the second contacting member is in a temperature range defined by a cold offset occurring boundary temperature of the first contacting member and/or a hot offset occurring boundary temperature of the first contacting member.

Here, a cold offset of the first contacting member is a transfer (offset) of toner, on the surface (image surface) of the printing medium, to the first contacting member since a surface temperature of the first contacting member is much lower than the temperature at which the fixing of toner is able to be carried out.

Moreover, a hot offset of the first contacting member is a transfer (offset) of toner, on the surface (image surface) of the printing medium, to the first contacting member since the surface temperature of the first contacting member is much higher than the temperature at which the fixing of toner is able to be carried out.

Further, the cold offset occurring boundary temperature of the first contacting member is the surface temperature of the first contacting member when the cold offset starts occurring, and the hot offset occurring boundary temperature of the first contacting member is the surface temperature of the first contacting member when the hot offset starts occurring.

The above-described configuration utilizes a mechanism of a transfer (the cold offset, the hot offset) of toner from the surface of the printing sheet to the first contacting member (fixing roller), so as to suppress (i) a transfer of toner to the second contacting member (pressure roller) (a transfer of toner, adhered to a back of the printing medium, to the second contacting member) and (ii) a transfer of toner, adhered to the second contacting member (pressure roller), to the first contacting member. Note that the transfer (the cold offset, the hot offset) of toner from the surface of the printing sheet to the first contacting member is a conventional problem, and is caused due to the surface temperature of the first contacting member.

Specifically, the control means controls the heating means so that the surface temperature of the second printing member is in the temperature range defined by the cold offset occurring boundary temperature of the first contacting member and/or the hot offset occurring boundary temperature of the first contacting member.

With this, as described above, it is possible to suppress a transfer of toner from the back of the printing medium to the second contacting member (a transfer of toner from the back of the printing medium (printing sheet)) and a transfer of toner from the second contacting member to the first contacting member (a transfer of toner from the second contacting member (pressure roller)).

As a result, it is possible to provide a fixing device which (i) can reduce toner contamination of a pair of rollers that are the first contacting member (fixing roller) and the second contacting member (pressure roller), (ii) is less likely to contaminate the printing medium, and (iii) requires low frequency of maintenance for removing toner.

Moreover, a fixing method of the present invention is a method for fixing an unfixed toner image on a printing medium by causing the printing medium to pass through a contacting region (i) where a first contacting member contacting a toner image surface and a second contacting member contacting a surface opposite to the toner image surface are in contact with each other and (ii) which is heated to a temperature at which fixing of toner is able to be carried out, and the fixing method includes, as steps of causing the first contacting member and the second contacting member to be such a state that the fixing is able to be carried out,: a first step of increasing a temperature of the first contacting member, and then increasing a temperature of the second contacting member by the first contacting member after the first contacting member reaches a first temperature that is lower than a predetermined temperature; and a second step of, after the first contacting member reaches a second temperature that is higher than the predetermined temperature, externally heating the second contacting member and substantially simultaneously starting to feed the printing medium to the contacting region.

According to this fixing method, after increasing the temperature of the first contacting member to the first temperature, the temperature of the second contacting member is increased by the first contacting member (for example, the temperature of the second contacting member is increased by heat transmission from the first contacting member).

Further, after the second contacting member reaches the second temperature, feeding of the printing medium is started, and substantially simultaneously the temperature of the second contacting member is increased by the external heating means. With this, the surface temperature of the second contacting member does not increase too much, and it is possible to easily control the surface temperature of the second contacting member to the predetermined temperature or lower.

As a result, it is possible to suppress the transfer of toner, adhered to the second contacting member, to the first contacting member when (in a warm-up) causing the first contacting member and the second contacting member to be such a state that the fixing is able to be carried out.

Moreover, a fixing method of the present invention is a method for fixing an unfixed toner image on a printing medium by causing the printing medium to pass through a contacting region (i) where a first contacting member contacting a toner image surface and a second contacting member contacting a surface opposite to the toner image surface and capable of being heated by external heating means are in contact with each other and (ii) which is heated to a temperature at which fixing of toner is able to be carried out, and the fixing method includes, as steps of cleaning toner adhered to the first contacting member and the second contacting member after completing the fixing,: a first step of lowering a temperature of the first contacting member; and a second step of maintaining a temperature of the external heating means to a temperature lower than a temperature of the external heating means when the printing medium passes through.

According to this fixing method, under such a state that the temperature of the first contacting member is lowered, the temperature of the external heating means which heats the second contacting member is maintained to a temperature lower than a temperature of the external heating means when the printing medium passes through. Therefore, the surface temperature of the second contacting member does not increase too much, and it is possible to easily control the surface temperature of the second contacting member to the predetermined temperature or lower.

With this, the transfer of toner, adhered to the second contacting member, to the first contacting member does not occur, and it is possible to surely clean the second contacting member.

Moreover, an image forming apparatus of the present invention includes: a photoreceptor on a surface of which an unfixed toner is formed; transfer means, contacting the photoreceptor, for transferring an unfixed toner image from the photoreceptor to a printing sheet; and fixing means for fixing the unfixed toner image transferred onto a printing medium by the transfer means, and the above-described fixing device is used as the fixing means.

In this case, in the above-described image forming apparatus, toner contamination on the back of the printing medium easily occurs by toner (fogging toner) adhered to the surface of the transfer means. Therefore, by applying the above-described fixing device, it is possible to suppress an unnecessary transfer of toner (a transfer of toner from the back of the printing medium, a transfer of toner from the pressure roller), and it is also possible to improve the quality of an image to be formed.

Additional objects, features, and strengths of the present invention will be made clear by the description below. Further, the advantages of the present invention will be evident from the following explanation in reference to the drawings.

BRIEF DESCRIPTION OF DRAWINGS

FIG. 2(*a*) is an explanatory diagram showing a relation among temperatures (° C.) of respective rollers and how much toner is transferred (offset), in a device of the present embodiment.

FIG. 2(*b*) is an explanatory diagram showing a relation among temperatures (° C.) of respective rollers and how much toner is transferred (offset), in a device of the present embodiment.

FIG. 2(*c*) is an explanatory diagram showing a relation among temperatures (° C.) of respective rollers and how much toner is transferred (offset), in a device of the present embodiment.

FIG. 3(*a*) is an explanatory diagram showing a relation between the temperature (° C.) of a pressure roller and the temperature (° C.) of toner on the back of a printing sheet, in the above device.

FIG. 3(*b*) is an explanatory diagram showing a relation between the temperature (° C.) of a pressure roller and the temperature (° C.) of toner on the back of a printing sheet, in the above device.

FIG. 3(*c*) is an explanatory diagram showing a relation between the temperature (° C.) of a pressure roller and the temperature (° C.) of toner on the back of a printing sheet, in the above device.

FIG. 5(*a*) is an explanatory diagram showing a relation among the temperature (° C.) of a pressure roller, the temperature (° C.) of a fixing roller, and occurrence or nonoccurrence of a cold offset, in a device.

FIG. 5(*b*) is an explanatory diagram showing a relation among the temperature (° C.) of a pressure roller, the temperature (° C.) of a fixing roller, and occurrence or nonoccurrence of a cold offset, in a device.

FIG. 5(*c*) is an explanatory diagram showing a relation among the temperature (° C.) of a pressure roller, the temperature (° C.) of a fixing roller, and occurrence or nonoccurrence of a cold offset, in a device.

FIG. 6(*a*) is an explanatory diagram showing a relation between the temperature (a low-temperature range) (° C.) of a fixing roller and the temperature (° C.) of toner on the surface of a printing sheet, in the above device.

FIG. 6(*b*) is an explanatory diagram showing a relation between the temperature (a low-temperature range) (° C.) of a fixing roller and the temperature (° C.) of toner on the surface of a printing sheet, in the above device.

FIG. 6(*c*) is an explanatory diagram showing a relation between the temperature (a low-temperature range) (° C.) of a fixing roller and the temperature (° C.) of toner on the surface of a printing sheet, in the above device.

FIG. 8(*a*) is an explanatory diagram showing the temperatures (° C.) of a fixing roller and a pressure roller and the temperature (° C.) of toner at the exit of a fixing nip portion Y at the moment of offset of toner T, adhered to the pressure roller, to the fixing roller in the above device.

FIG. 8(*b*) is an explanatory diagram showing the temperatures (° C.) of a fixing roller and a pressure roller and the temperature (° C.) of toner at the exit of a fixing nip portion Y at the moment of offset of toner T, adhered to the pressure roller, to the fixing roller in the above device.

FIG. 8(*c*) is an explanatory diagram showing the temperatures (° C.) of a fixing roller and a pressure roller and the temperature (° C.) of toner at the exit of a fixing nip portion Y at the moment of offset of toner T, adhered to the pressure roller, to the fixing roller in the above device.

FIG. 9(*a*) is an explanatory diagram showing a relation among the temperature (° C.) of a pressure roller, the temperature (° C.) of a fixing roller, occurrence or nonoccurrence of a hot offset, and the temperature (° C.) of toner on the surface of the printing sheet, in the above device.

FIG. 9(*b*) is an explanatory diagram showing a relation among the temperature (° C.) of a pressure roller, the temperature (° C.) of a fixing roller, occurrence or nonoccurrence of a hot offset, and the temperature (° C.) of toner on the surface of the printing sheet, in the above device.

FIG. 9(*c*) is an explanatory diagram showing a relation among the temperature (° C.) of a pressure roller, the temperature (° C.) of a fixing roller, occurrence or nonoccurrence of a hot offset, and the temperature (° C.) of toner on the surface of the printing sheet, in the above device.

FIG. 10(*a*) is an explanatory diagram showing a relation between the temperature (a high-temperature range) (° C.) of a fixing roller and the temperature (° C.) of toner on the surface of the printing sheet, in the above device.

FIG. 10(*b*) is an explanatory diagram showing a relation between the temperature (a high-temperature range) (° C.) of a fixing roller and the temperature (° C.) of toner on the surface of the printing sheet, in the above device.

FIG. 10(*c*) is an explanatory diagram showing a relation between the temperature (a high-temperature range) (° C.) of a fixing roller and the temperature (° C.) of toner on the surface of the printing sheet, in the above device.

FIG. 12(*a*) shows control sequences in a warm-up and in a return from a sleep mode, and is an explanatory diagram showing a relation between the temperatures of respective rollers and a time elapsed from start of driving of a fixing device, in the present embodiment.

FIG. 12(*b*) is an explanatory diagram showing states of a fixing roller and an external heating roller in respective sequences shown in FIG. 12(*a*).

FIG. 13(*a*) is an explanatory diagram showing a relation between positions in a longitudinal direction of a printing sheet and the temperatures of respective rollers contacting the positions, in the present embodiment.

FIG. 13(*b*) is an explanatory diagram showing a relation between positions in a longitudinal direction of a printing sheet and the temperatures of respective rollers contacting the positions, in Comparative Example X.

FIG. 13(*c*) is an explanatory diagram showing a relation between positions in a longitudinal direction of あ|printing sheet and the temperatures of respective rollers contacting the positions, in Comparative Example Y.

FIG. 14 is an explanatory diagram which puts together respective conditions and occurrence or nonoccurrence of offset, in Comparative Examples X and Y, and the present embodiment.

FIG. 15 is an explanatory diagram showing kinds of fixing devices used in the present embodiment.

FIG. 20(*b*) is an enlarged view of a transfer unit in FIG. 20(*a*).

FIG. 25(*a*) shows conventional control sequences in a warm-up and a return from a sleep mode, and is an explanatory diagram showing a relation between the temperatures of respective rollers and a time elapsed from start of driving of a fixing device.

FIG. 25(*b*) is an explanatory diagram showing states of a fixing roller and an external heating roller in respective sequences shown in FIG. 25(*a*).

BEST MODE FOR CARRYING OUT THE INVENTION

The following will explain one embodiment of the present invention on the basis of FIGS. 1 to 25(*b*). Note that the present invention is not limited to the following explanation.

(Configuration of Fixing Device)

Figure 1:
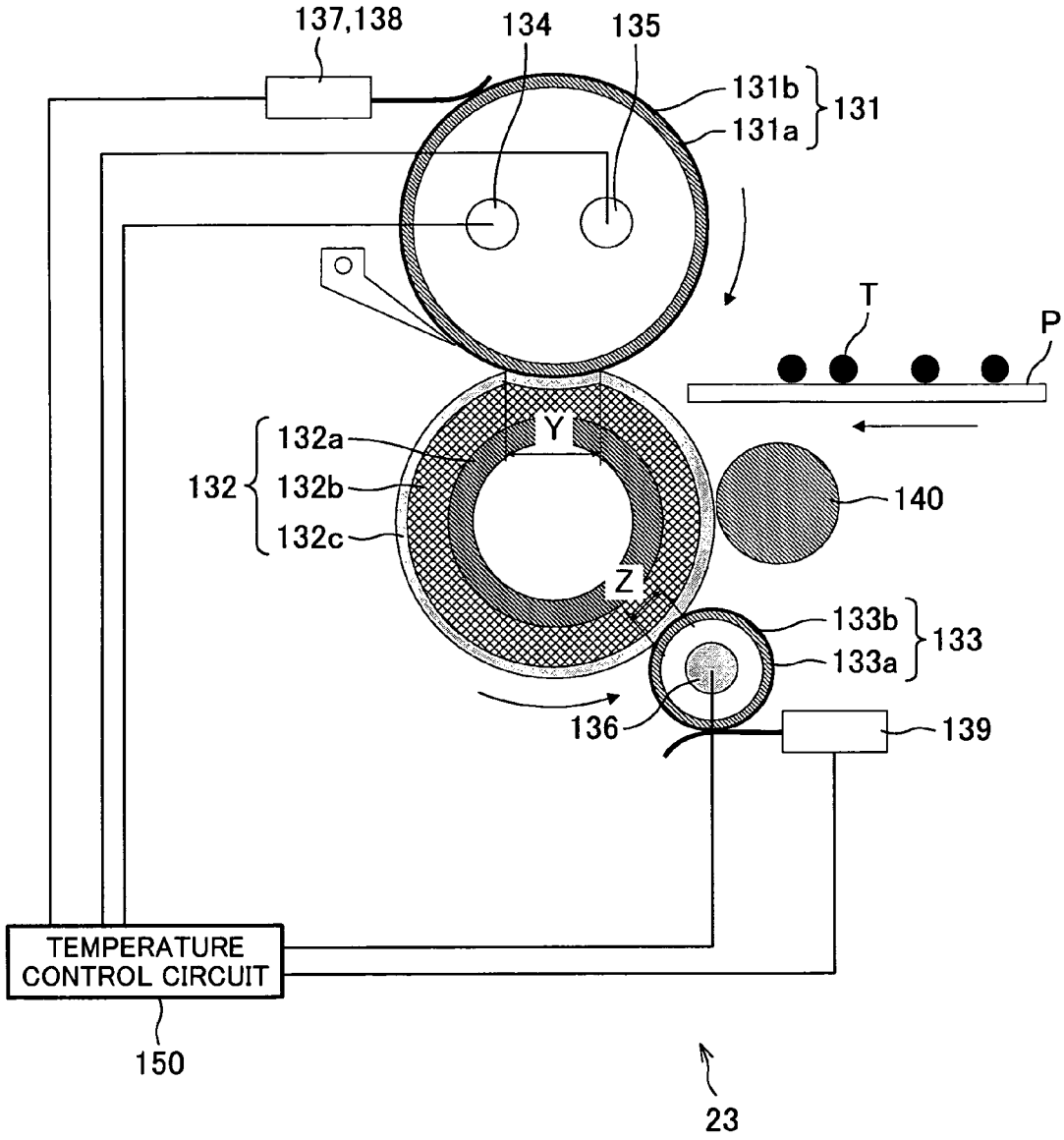
FIG. 1 is an explanatory diagram showing a cross section of a configuration of a fixing device of an embodiment.

First, the following will explain a configuration of a fixing device of the present embodiment in reference to FIG. 1.

FIG. 1 is an explanatory diagram showing a cross section of a configuration of important parts of a fixing device 23 of the present embodiment. Note that a configuration, function, etc. of a copier to which the fixing device 23 is applied will be explained later in detail.

As shown in FIG. 1, the fixing device 23 includes a fixing roller (first contacting member) 131, a pressure roller (second contacting member) 132, an external heating roller (external heating means) 133, heater lamps 134, 135, and 136, temperature sensors 137, 138, and 139, a cleaning roller (cleaning means) 140, and a temperature control circuit (temperature control means) 150.

Here, the external heating roller 133 is heating means for heating the pressure roller 132. The heater lamps (heating means) 134 and 135 are heat sources for heating the fixing roller 131, and the heater lamp 136 is a heat source for heating the external heating roller 133. Moreover, the temperature sensors 137 and 138 detect the temperature of the fixing roller 131, and the temperature sensor 139 detects the temperature of the external heating roller 133.

The following will explain these parts in detail.

First, the heater lamps 134 and 135 are halogen heaters, and are provided inside the fixing roller 131. The heater lamp 136 is also a halogen heater, and is provided inside the external heating roller 133. By energizing the heater lamps 134 to 136 by the temperature control circuit, the heater lamps 134 to 136 emit light in accordance with a predetermined heat generation distribution and emit infrared light, so that inner circumference surfaces of the fixing roller 131 and the external heating roller 133 are heated.

The fixing roller 131 is heated to a predetermined temperature (for example, 200° C.) by the heater lamps 134 and 135, and this heat heats a printing sheet (printing medium) P which passes through a fixing nip portion Y (contacting region) of the fixing device and on which an unfixed toner image is formed.

The fixing roller 131 includes a core bar 131*a* as a main body and a release layer 131*b*. The release layer 131*b* is formed on the outer peripheral surface of the core bar 131*a*, and prevents the toner T, on the printing sheet P, from transferring (offsetting) to the fixing roller 131.

Used for the core bar 131*a* are, for example, metals such as iron, stainless steel, aluminum, copper, or the like, or alloys thereof. In the present embodiment, an iron (STKM) core bar having the diameter of 40 mm is used as the core bar 131*a*, and the thickness of the iron core bar is 1.3 mm for the purpose of reducing its heat capacity.

Suitable as the release layer 131*b* are fluorocarbon resin, such as PFA (copolymer of tetrafluoroethylene and perfluoroalkylvinylether) or PTFE (polytetrafluoroethylene), silicon rubber, fluorocarbon rubber, etc. In the present embodiment, used as the release layer 131*b* is a layer that is made of a blend of PFA and PTFE, has the thickness of 25 μm, and is formed by application and firing.

The pressure roller 132 is configured such that a heat-resistant elastic material layer 132*b* made of, for example, silicon rubber is provided on the outer peripheral surface of a core bar 132*a*, such as iron and steel, stainless steel, or aluminum. Note that on the surface of the heat-resistant elastic material layer 132*b*, a release layer 132*c* made of the same fluorocarbon resin as the fixing roller 131 may be formed.

The pressure roller 132 of the present embodiment is configured such that (i) the heat-resistant elastic material layer 132*b* made of silicon rubber (hardness JIS-A50°) having the thickness of 6 mm is formed on the stainless-steel core bar 132*a* having the diameter of 40 mm and (ii) the release layer 132*c* made of a PFA tube having the thickness of 50 μm is provided on the surface of the heat-resistant elastic material layer 132*b*. The pressure roller 132 contacts the fixing roller 131 at a pressure of 76 kgf (745 N) by a pressure member (not shown), such as a spring. With this, between the fixing roller 131 and the pressure roller 132, a fixing nip portion Y having the width of about 6 mm is formed.

The external heating roller 133 includes therein the heater lamp 136 as a heat source, and is provided with respect to the pressure roller 132 and provided upstream of the transfer nip portion Y. In addition, the external heating roller 133 contacts the pressure roller 132 at a predetermined pressure force. Between the pressure roller 132 and the external heating roller 133, a heating nip portion Z is formed.

The external heating roller 133 is configured such that a heat-resistant release layer 133*b* is formed on a hollow cylindrical core material 133*a*. The core material 133*a* is made of, for example, an aluminum-based material or an iron-based material, and the release layer 133*b* is made of a synthetic resin material which excels in heat resistance and demoldability. The synthetic resin material is exemplified by elastomer, such as silicon rubber or fluorocarbon rubber, or fluorocarbon resin, such as PFA or PTFE. In the present embodiment, used as a release material of the release layer 133*b* is a material that is made of a blend of PFA and PTFE, has the thickness of 25 μm, and is formed by application and firing.

The cleaning roller 140 removes toner, paper strips, etc. adhered to the pressure roller 132, so as to prevent the pressure roller 132 from being contaminated. That is, the cleaning roller 140 is journaled upstream of the heating nip portion Z so as to rotate in accordance with the rotation of the pressure roller 132, and contacts the pressure roller 132 at a predetermined pressure force. Used as the cleaning roller 140 is a cylindrical metal core material made of, for example, an aluminum-based material or an iron-based material. In the present embodiment, used for the cleaning roller 140 is an aluminum-based material which excels in heat conductivity.

On the peripheral surface of the fixing roller 131, thermistors 137 and 138 are provided for detecting the temperature of the fixing roller 131. Similarly, on the peripheral surface of the external heating roller 133, a thermistor 139 is provided for detecting the temperature of the external heating roller 133. With these, the surface temperatures of respective rollers are detected. Then, on the basis of data of the temperatures detected by the thermistors 137 to 139, the temperature control circuit 150 controls energization of the heater lamps 134 to 136 so that respective rollers 131 to 133 are kept at a predetermined temperature.

Note that in the present embodiment, the rated outputs of the heater lamps 134 and 135 are 950 W in total, and the rated output of the heater lamp 136 is 200 W.

Thus, the temperatures of the fixing roller 131 and the pressure roller 132 are controlled by the temperature control circuit 150 to a predetermined temperature (the temperature control of the pressure roller 132 will be described later in detail), and in such a state, the printing sheet P on which an unfixed toner image is formed is conveyed to the fixing nip portion Y at a predetermined fixing speed and predetermined copying speed, and the unfixed toner image is fixed by heat and pressure.

(Temperature Control of Pressure Roller by Temperature Control Circuit)

The following will explain the temperature control of the pressure roller 132 in reference to FIGS. 1 to 11 and 15. The temperature control of the pressure roller 132 is carried out to prevent (i) a transfer of toner T, adhered to the back of the printing sheet, to the surface of the pressure roller 132 and (ii) a transfer of toner T, adhered to the surface of the pressure roller 132, to the fixing roller 131.

First, referring to FIGS. 1 to 7 and 15, the following will explain how to prevent the transfer of the toner T, adhered to the back of the printing sheet, to the pressure roller 132.

As will be described later, the present embodiment employs a contact-type transfer belt as a transfer unit 26 (see FIGS. 20(*a*) and 20(*b*)). Thus, in the case of using contact-type transfer means, there is conventionally a possibility that the transfer belt is contaminated by the fogging toner T on a photoreceptor because of an interval between sheets when the sheet are fed continuously, and as a result, the fogging toner T adheres to the back of the printing sheet P, and the pressure roller 132 of the fixing device 23 provided downstream of the transfer belt is contaminated terribly.

In view of the fact that the temperature of the pressure roller 132 is much lower than the temperature of the fixing roller 131, the transfer of the toner T, adhered to the back of the printing sheet, to the pressure roller 132 can be considered to be the same kinds of phenomena as a cold offset phenomenon (a phenomenon in which the toner T on the surface (the surface on which an image is formed, that is, an image surface) of the printing sheet P transfers (offsets) to the fixing roller 131 since the temperature of the fixing roller 131 is too low) which usually becomes problematic in the fixing device 23.

Here, the following experiment was carried out to find out the relation between the temperature of the pressure roller 132 and the amount of the toner T transferred from the back of the printing sheet to the pressure roller 132. FIG. 15 is details of the fixing devices 23 (Devices 1 to 3) used in this experiment.

This experiment was carried out in the following procedure: (i) Device 1 (a fixing speed was 365 mm/s, the diameter of the fixing roller was 40, the material of the core bar of the fixing roller was STKM, the thickness of the core bar of the fixing roller was 1.3 mm, the diameter of the pressure roller was 40, a rubber layer of the pressure roller was a silicon solid, and the width of the fixing nip was 6 mm), Device 2 (a fixing speed was 225 mm/s, the diameter of the fixing roller was 35, the material of the core bar of the fixing roller was STKM, the thickness of the core bar of the fixing roller was 0.4 mm, the diameter of the pressure roller was 35, a rubber layer of the pressure roller was a silicon sponge, and the width of the fixing nip was 4 mm), and Device 3 (a fixing speed was 122 mm/s, the diameter of the fixing roller was 25, the material of the core bar of the fixing roller was aluminum, the thickness of the core bar of the fixing roller was 1 mm, the diameter of the pressure roller was 25, a rubber layer of the pressure roller was a silicon sponge, and the width of the fixing nip was 2 mm) were prepared; (ii) the temperature of the fixing roller 131 was kept constant at 200° C.; (iii) the temperature of the pressure roller 132 was controlled by the external heating roller 133 to a predetermined temperature; and (iv) under these conditions, 300 printing sheets P were fed continuously.

After feeding the sheets, the toner T adhered to the pressure roller 132 and the toner T adhered to the external heating roller 133 were collected by a mending tape, and those are compared visually. Note that if the toner T adheres to the cleaning roller 140, the mending tape cannot collect this toner T due to strong adhesive force. Therefore, this experiment was carried out without the cleaning roller 140.

FIGS. 2(*a*) to 2(*c*) show result of this experiment. FIGS. 2(*a*) to 2(*c*) show a relation (visual comparison) among temperatures (° C.) of respective rollers (the fixing roller 131, the external heating roller 133, and the pressure roller 132) in Devices 1 to 3 and a state of transfer of the toner T. Here, the temperature of the fixing roller 131 is kept constant at 200° C. in Devices 1 to 3, and the temperature of the pressure roller 132 is from 99° C. to 136° C. in Device 1 (FIG. 2(*a*)), from 102° C. to 138° C. in Device 2 (FIG. 2(*b*)), and from 105° C. to 141° C. in Device 3 (FIG. 2(*c*)).

According to FIGS. 2(*a*) to 2(*c*), when the temperature of the pressure roller 132 is in such low-temperature range, the amount of the toner T transferred from the back of the printing sheet to the pressure roller 132 decreases as the temperature of the pressure roller 132 increases, irrespective of the kinds of the fixing devices 23. In addition, when the temperature of the pressure roller 132 is 130° C. or higher, the toner T is almost never transferred in all Devices 1 to 3.

The following will focus on the temperature of the toner on the back of the printing sheet when the transfer of the toner to the pressure roller 132 occurs, and consider a relation among the temperature (° C.) of the fixing roller 131, the temperature (° C.) of the pressure roller 132, and the temperature of the toner on the back of the printing sheet (hereinafter referred to as "the temperature of the toner on the back of the printing sheet") just after the printing sheet passed through the fixing nip portion Y.

The temperature of the toner just after the printing sheet passes through the fixing nip portion Y can be measured in an experiment actually using an infrared thermometer. However, to more easily find out the temperature, a simulation using one-dimensional thermal conductivity analysis is carried out here.

Here, modeled by one-dimensional model is a state in which the printing sheet P on the back of which a toner layer is formed passes through the fixing nip portion Y of the above-described three fixing devices 23 (Devices 1 to 3), and analyzed is the relation among the temperature (° C.) of the fixing roller 131, the temperature (° C.) of the pressure roller 132, and the temperature (° C.) of the toner on the back of the printing sheet.

FIGS. 3(*a*) to 3(*c*) show results of this analysis. FIGS. 3(*a*) to 3(*c*) show the relation between the temperature (° C.) of the pressure roller 132 and the temperature (° C.) of the toner on the back of the printing sheet in Devices 1 to 3 under such conditions that (i) the temperature of the fixing roller 131 is 190° C., 200° C., or 210° C., (ii) the temperature of the pressure roller 132 is changed in a range from 100° C. to 140° C.

As shown in FIGS. 3(*a*) to FIGS. 3(*c*), where the temperature of the pressure roller 132 is x, and the temperature of the toner on the back of the printing sheet is y, the relation between x and y in Device 1 can be approximately shown by the following formula.

$$y=0.445x+41.3$$

Moreover, the relation between x and y in Device 2 can be approximately shown by the following formula.

$$y=0.420x+44.6$$

Further, the relation between x and y in Device 3 can be approximately shown by the following formula.

$$y=0.449x+40.6$$

As above, the relations in Devices 1 to 3 between the temperature of the pressure roller 132 and the temperature of the toner on the back of the printing sheet are shown by approximate straight lines, substantially irrespective of the temperature of the fixing roller 131. In addition, the approximate straight lines are substantially identical with each other, irrespective of the kinds of the fixing devices (Devices 1 to 3).

Figure 4:
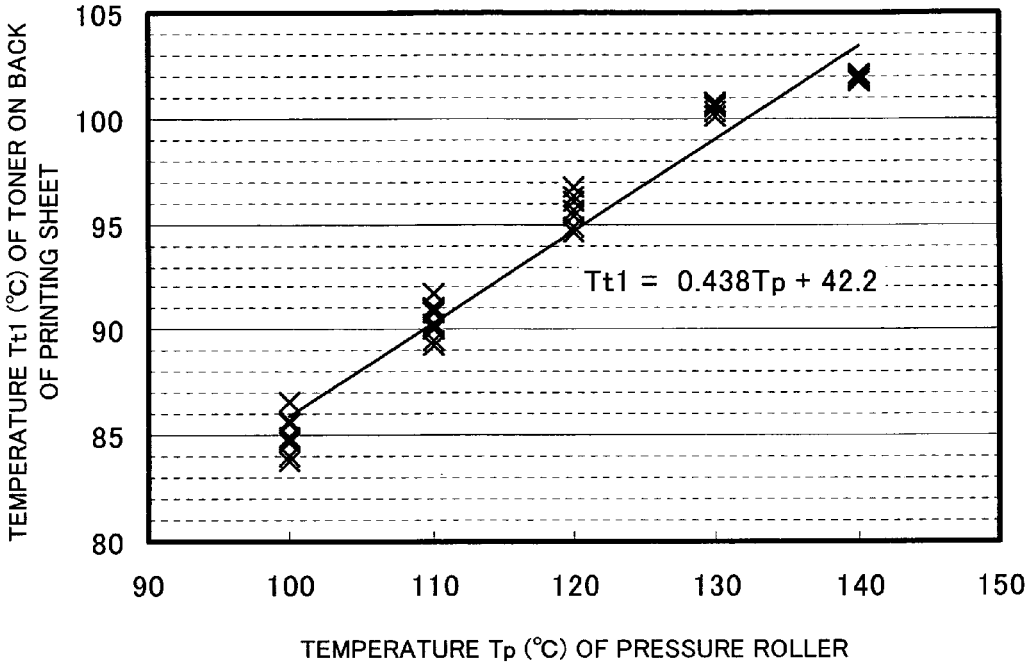
FIG. 4 is an explanatory diagram showing a relation between the temperature (° C.) of a pressure roller and the temperature (° C.) of toner on the back of a printing sheet, in the present embodiment.

Here, FIG. 4 shows the result obtained by putting together the results of three fixing devices. FIG. 4 shows the relation (shown by an approximate straight line) between the temperature (° C.) of the pressure roller 132 and the temperature (° C.) of the toner on the back of the printing sheet under such conditions that (i) the kind of the fixing device is not specified, (ii) the temperature of the fixing roller 131 is not specified, and (iii) the temperature of the pressure roller 132 is changed in a range from 100° C. to 140° C.

According to FIG. 4, where the temperature of the pressure roller 132 is Tp, and the temperature of the toner on the back of the printing sheet is Tt1, Tt1 can be approximately shown by Formula (1) below.

$$Tt1=0.438Tp+42.2 \quad (1)$$

Thus, the temperature Tt1 of the toner on the back of the printing sheet can be shown only by the temperature Tp of the pressure roller 132. This is because, since the heat of the pressure roller 132 is directly transferred to the toner layer adhered to the back of the printing sheet, while the heat of the fixing roller 131 is transferred through the printing sheet P to the toner layer adhered to the back of the sheet, a contributing rate of the fixing roller 131 with respect to the temperature rising of the toner is much lower than a contributing rate of the pressure roller 132 with respect to the temperature rising of the toner.

According to FIGS. 2(*a*) to 2(*c*), when the temperature Tp of the pressure roller 132 is 130° C., an offset (a transfer of the toner T, adhered to the back of the printing sheet, to the pressure roller 132) to the pressure roller 132 starts occurring. Therefore, according to Formula (1), the temperature of the toner when the offset to the pressure roller 132 starts occurring is 99.1° C.

Next, the following experiment was carried out to find out a relation between the temperature of the fixing roller 131 and the cold offset phenomenon (an offset from the surface of the printing sheet P to the fixing roller 131).

Whether the cold offset occurs or not was examined by using the following experimental procedure: (i) the heater lamp 136 for the external heating roller 133 was turned off, (ii) the fixing roller 131 was set to a predetermined temperature (from 200° C. to 110° C., at intervals of 10° C.), and idled, (iii) when the temperature of the pressure roller 132 was stable, the printing sheet P on the front edge of which a black belt-like unfixed image was formed and whose basis weight was 75 g was fed.

FIGS. 5(*a*) to 5(*b*) show results of this experiment. FIGS. 5(*a*) to 5(*c*) show the relation among the temperature (° C.) of the pressure roller 132, the temperature (° C.) of the fixing roller 131, and occurrence or nonoccurrence of the cold offset in Devices 1 to 3. Here, the temperature of the fixing roller 131 is from 110° C. to 200° C., and correspondingly the temperature of the pressure roller 132 is from 100° C. to 185° C.

According to FIGS. 5(*a*) to 5(*c*), irrespective of the kinds of the fixing devices 23, the cold offset does not occur when the temperature of the fixing roller 131 is 130° C. or higher, however the cold offset occurs when the temperature of the fixing roller 131 is 120° C. or lower.

Next, the following will focus on the temperature of the toner on the surface of the printing sheet when the cold offset occurs, and consider a relation among the temperature of the fixing roller 131, the temperature of the pressure roller 132, and the temperature of the toner on the surface (the image surface) of the printing sheet (hereinafter referred to as "the temperature of the toner on the surface of the printing sheet") just after the printing sheet passes through the fixing nip portion Y.

Note that regarding the temperature of the toner on the surface (the image surface) of the printing sheet, a simulation using one-dimensional thermal conductivity analysis was carried out.

FIGS. 6(*a*) to 6(*c*) show results of this simulation. FIGS. 6(*a*) to 6(*c*) show the relation between the temperature (° C.) of the fixing roller 131 and the temperature (° C.) of the toner on the surface of the printing sheet in Devices 1 to 3 under such conditions that (i) the temperature of the pressure roller 132 is 110° C., 120° C., or 130° C., and (ii) the temperature of the fixing roller 131 is changed in a range from 120° C. to 150° C.

As shown in FIGS. 6(*a*) to 6(*c*), where the temperature of the fixing roller 131 is x, and the temperature of the toner on the surface of the printing sheet is y, the relation between x and y in Device 1 can be approximately shown by the following formula.

$$y=0.304x+63.6$$

Moreover, the relation between x and y in Device 2 can be approximately shown by the following formula.

$$y=0.280x+67.6$$

Further, the relation between x and y in Device 3 can be approximately shown by the following formula.

$$y=0.293x+65.6$$

As above, the relations in Devices 1 to 3 between the temperature of the fixing roller 131 and the temperature of the toner on the surface of the printing sheet are shown by approximate straight lines, substantially irrespective of the temperature of the pressure roller 132. In addition, the approximate straight lines are substantially identical with each other, irrespective of the kinds of the fixing devices 23.

Figure 7:
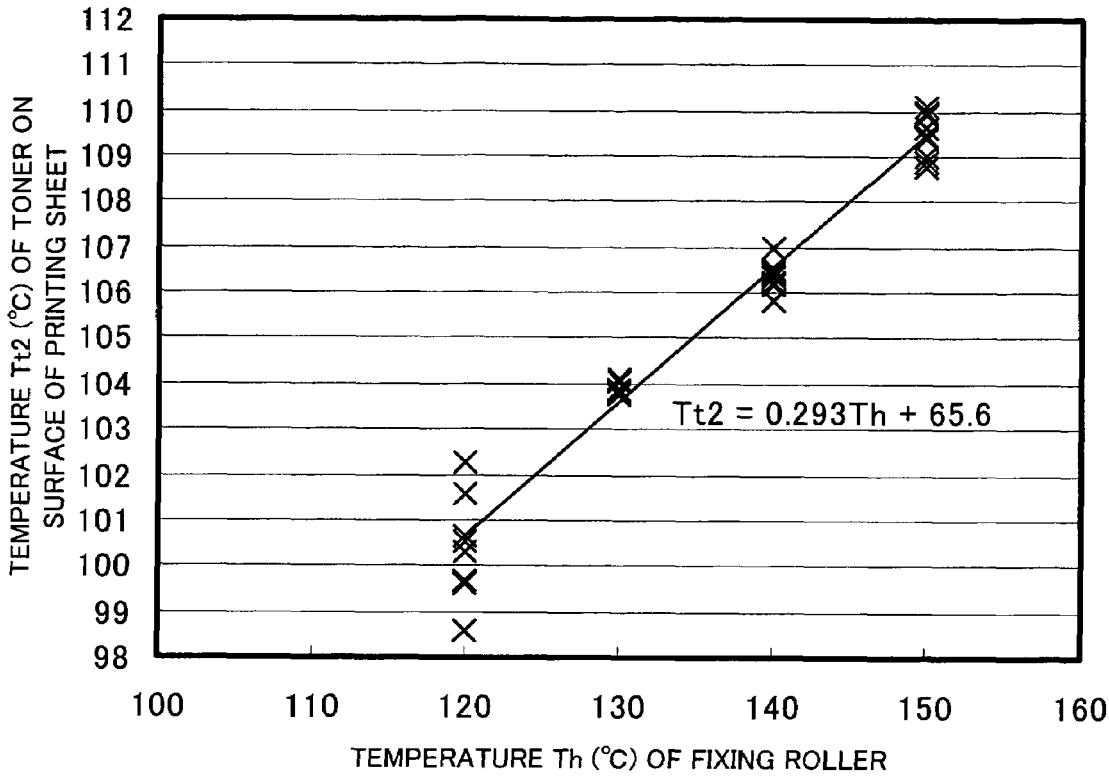
FIG. 7 is an explanatory diagram showing a relation between the temperature (a low-temperature range) (° C.) of a fixing roller and the temperature (° C.) of toner on the surface of a printing sheet, in the present invention.

Here, FIG. 7 shows the result obtained by putting together the results of three fixing devices. FIG. 7 shows the relation (shown by an approximate straight line) between the temperature (° C.) of the fixing roller 131 and the temperature (° C.) of the toner on the surface of the printing sheet under such conditions that (i) the kind of the fixing device is not specified, (ii) the temperature of the pressure roller 132 is not specified, and (iii) the temperature of the fixing roller 131 is changed in a range from 120° C. to 150° C.

According to FIG. 7, where the temperature of the fixing roller 131 is Th, and the temperature of the toner on the surface (the image surface) of the printing sheet dust after the printing sheet passes through the fixing nip portion Y) is Tt2, Tt2 can be approximately shown by Formula (2) below.

$$Tt2=0.293Th+65.6 \quad (2)$$

Thus, the temperature of the toner on the surface of the printing sheet can be shown only by the temperature Th of the fixing roller 131. This is because, since the heat of the fixing roller 131 is directly transferred to the toner layer on the image surface of the printing sheet, while the heat of the pressure roller 132 is transferred through the printing sheet P to the toner layer on the image surface, a contributing rate of the pressure roller 132 with respect to the temperature rising of the toner is much lower than a contributing rate of the fixing roller 131 with respect to the temperature rising of the toner.

According to FIGS. 5(*a*) to 5(*c*), when the temperature Th of the fixing roller 131 is 120° C., the cold offset to the fixing roller 131 starts occurring. Therefore, according to Formula (2), the temperature of the toner on the surface of the printing sheet when the cold offset starts occurring is 100.8° C.

This temperature of the toner is substantially the same as the temperature (99.1° C.) of the toner when the transfer of the toner to the pressure roller 132 starts occurring. Therefore, the transfer of the toner T, adhered to the back of the printing sheet, to the pressure roller 132 can be regarded as one of the cold offset phenomena to the pressure roller 132.

According to the results obtained from the foregoing description, to prevent the transfer of the toner T, adhered to the back of the printing sheet, to the pressure roller 132, the temperature of the pressure roller 132 may be set so that the temperature of the toner on the back of the printing sheet is a certain temperature at which the cold offset does not occur, or higher.

That is, where the temperature (a cold offset occurring boundary temperature of the fixing roller 131) of the fixing roller 131 when the cold offset starts occurring is Thc, a temperature (the temperature of the toner when the cold offset starts occurring) Tt2' of the toner on the surface of the printing sheet when the cold offset starts occurring can be shown by Formula (3) below in accordance with Formula (2).

$$Tt2'=0.293Thc+65.6 \quad (3)$$

Here, in view of the fact that the transfer of the toner T, adhered to the back of the printing sheet, to the pressure roller 132 can be regarded as one of the cold offset phenomena to the pressure roller 132, the relation between (i) the temperature Tt1' of the toner on the back of the printing sheet when the transfer to the pressure roller 132 starts occurring and (ii) the temperature Tt2' of the toner on the surface of the printing sheet when the cold offset starts occurring can be shown by Formula (4) below.

$$Tt1'=Tt2' \quad (4)$$

Further, where the temperature of the pressure roller 132 when the transfer of the toner to the pressure roller 132 starts occurring is Tp', Tp' can be shown by Formula (5) in accordance with Formulas (4), (1), and (3).

$$Tt1'=0.438Tp'+42.2=0.293Thc+65.6 \therefore Tp'=0.669Thc+53.4 \quad (5)$$

With this, to prevent the transfer of the toner T, adhered to the back of the printing sheet, to the pressure roller 132, the temperature Tp of the pressure roller 132 may be controlled in accordance with Formula (6) below.

$$\therefore Tp \geqq 0.669Thc+53.4 \quad (6)$$

In view of the fact that, in FIGS. 5(*a*) to 5(*c*), the cold offset does not occur when the temperature of the fixing roller 131 is 130° C. but occurs when the temperature of the fixing roller 131 is 120° C., a cold offset occurring boundary temperature Thc of the fixing roller 131 may be 125° C. that is between 120° C. and 130° C.

Next, referring to FIGS. 8(*a*) to 11 and 15, the following will explain prevention of the transfer of the toner T, adhered to the surface of the pressure roller 132, to the fixing roller 131.

In the case of providing the cleaning roller 140 only for the pressure roller 132 as in the present embodiment, there is conventionally a possibility that the toner T remained on the surface of the pressure roller 132 since the cleaning roller 140 cannot clean completely is transferred again from the pressure roller 132 to the fixing roller 131, and the toner T contaminates the image surface of the printing sheet.

The transfer of the toner T, adhered to the surface of the pressure roller 132, to the fixing roller 131 occurs when the temperature of the pressure roller 132 becomes high and close to the temperature of the fixing roller 131. Therefore, this transfer of the toner T can be considered to be the same kinds of phenomena as a hot offset phenomenon (a phenomenon in which the toner on the surface (the image surface) of the printing sheet transfers (offsets) to the fixing roller 131 since the temperature of the fixing roller 131 is too high) which usually becomes problematic in the fixing device.

Here, the following experiment was carried out to find out the relation among the temperature of the pressure roller 132, the temperature of the fixing roller 131, and the amount of the toner T transferred from to the surface of the pressure roller 132 to the fixing roller 131.

In this experiment, (i) three fixing devices 23 (Devices 1 to 3) shown in FIG. 15 were used, (ii) the temperature of the fixing roller 131 was controlled to 200° C., (iii) the heater lamp 136 for the external heating roller 133 was turned off, (iv) 300 printing sheets P were fed continuously. Thus, contamination by the toner was compulsorily made on the surfaces of the pressure roller 132 and the external heating roller 133. Then, with the temperature of the fixing roller 131 controlled to a predetermined temperature, the heater lamp 136 for the external heating roller 133 was turned on, and simultaneously the fixing device 23 idled. In this way, the temperature of the pressure roller 132 was increased. Then, the temperature of the pressure roller 132 was measured at the moment of an offset of the toner T, adhered to the external heating roller 133 and the pressure roller 132, to the fixing roller 131. Note that this experiment was carried out without the cleaning roller 140.

Further, this experiment calculated the temperature of the toner, by the above-described one-dimensional thermal conductivity analysis, at an exit of the fixing nip portion Y at the moment of the offset of the toner T, adhered to the external heating roller 133 and the pressure roller 132, to the fixing roller 131.

FIGS. 8(*a*) to 8(*c*) show results of this experiment. FIGS. 8(*a*) to 8(*c*) show the temperature (° C.) of the fixing roller 131, the temperature (° C.) of the pressure roller 132, and the temperature (° C.) of the toner at an exit of the fixing nip portion Y at the moment of the transfer of the toner T, adhered to the external heating roller 133 and the pressure roller 132, to the fixing roller 131 in Devices 1 to 3.

According to FIGS. 8(*a*) to 8(*c*), the transfer of the toner T from the pressure roller 132 to the fixing roller 131 occurs when the temperature of the toner at an exit of the fixing nip portion Y is substantially 190° C., irrespective of the kinds of the fixing devices 23, the temperature of the fixing roller 131, and the temperature of the pressure roller 132.

Moreover, according to FIGS. 8(*a*) to 8(*c*), where the temperature of the toner T at an exit of the fixing nip portion Y is Tt3, the temperature of the fixing roller 131 is Th, and the temperature of the pressure roller 132 is Tp, Tt3 can be approximately shown by Formula (7) below.

$$Tt3=(Th+Tp)/2 \quad (7)$$

This is because, since the printing sheet P does not exist at the fixing nip portion Y, both the heat from the fixing roller 131 and the heat from the pressure roller 132 transfers directly to the toner layer (the toner T adhered to, for example, the pressure roller 132).

The following will discuss a relation among the temperature of the fixing roller 131, the temperature of the pressure roller 132, and the hot offset phenomenon (the offset from the surface of the printing sheet to the fixing roller 131).

Whether the hot offset occurs or not was examined by using the following experimental procedure: (i) the heater lamp for the external heating roller was turned off, (ii) the fixing roller 131 was set to a predetermined temperature (from 220° C. to 260° C., at intervals of 10° C.), and idled, (iii) when the temperature of the pressure roller 132 was saturated, the printing sheet on the front edge of which a black belt-like unfixed image was formed and whose basis weight was 75 g was fed.

Further, this experiment calculated the temperature of the toner on the surface of the printing sheet just after the printing sheet passed through the fixing nip portion by the above-described one-dimensional thermal conductivity analysis, under each experimental condition.

FIGS. 9(*a*) to 9(*c*) show results of this experiment. FIGS. 9(*a*) to 9(*c*) show a relation among the temperature (° C.) of the pressure roller 132, the temperature (° C.) of the fixing roller 131, occurrence or nonoccurrence of the hot offset, and the temperature (° C.) of the toner T on the surface of the printing sheet, in Devices 1 to 3. Here, the temperature of the fixing roller 131 is from 220° C. to 260° C., as described above.

According to FIGS. 9(*a*) to 9(*c*), irrespective of the kinds of the fixing devices 23, the hot offset does not occur when the temperature of the fixing roller 131 is 240° C. or lower but occurs when the temperature of the fixing roller 131 is 250° C. or higher.

The following will examine a relation between the temperature Th of the fixing roller 131 and a temperature Tt4 of the toner on the surface of the printing sheet Oust after the printing sheet passes through the fixing nip portion Y).

FIGS. 10(*a*) to 10(*c*) show results of this. FIGS. 10(*a*) to 10(*c*) show a relation between the temperature Th (° C.) of the fixing roller 131 and the temperature Tt4 (° C.) of the toner on the surface of the printing sheet when the temperature Th of the fixing roller 131 is changed in a range from 220° C. to 260° C. in Devices 1 to 3.

As shown in FIGS. 10(*a*) to 10(*c*), where the temperature Th of the fixing roller 131 is x, and the temperature Tt4 of the toner on the surface of the printing sheet is y, the relation between x and y in Device 1 can be approximately shown by the following formula.

$$y=0.767x$$

Moreover, the relation between x and y in Device 2 can be approximately shown by the following formula.

$$y=0.786x$$

Further, the relation between x and y in Device 3 can be approximately shown by the following formula.

$$y=0.777x$$

As above, the relations in Devices 1 to 3 between the temperature Th of the fixing roller 131 and the temperature Tt4 of the toner on the surface of the printing sheet are shown by approximate straight lines. In addition, the approximate straight lines are substantially identical with each other, irrespective of the kinds of the fixing devices 23.

Figure 11:
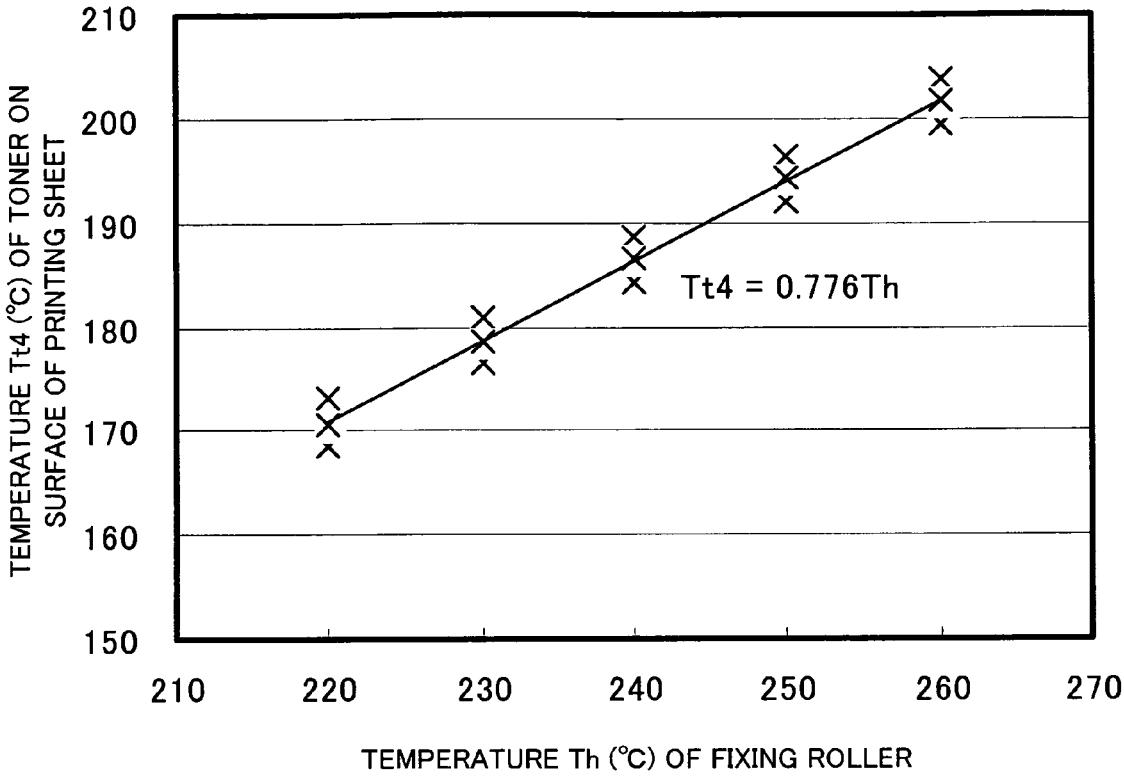
FIG. 11 is an explanatory diagram showing a relation between the temperature (a high-temperature range) (° C.) of a fixing roller and the temperature (° C.) of toner on the surface of the printing sheet, in the present embodiment.

Here, FIG. 11 shows the result obtained by putting together the results of three fixing devices 23. FIG. 11 shows the relation (shown by an approximate straight line) between the temperature Th (° C.) of the fixing roller 131 and the temperature Tt4 (° C.) of the toner on the surface of the printing sheet under such conditions that (i) the kind of the device is not specified, (ii) the temperature of the pressure roller 132 is not specified, and (iii) the temperature Th of the fixing roller 131 is changed in a range from 220° C. to 260° C.

According to FIG. 11, the relation between the temperature Th of the fixing roller 131 and the temperature Tt4 of the toner on the surface of the printing sheet can be approximately shown by Formula (8) below.

$$Tt4=0.776Th \tag{8}$$

According to FIGS. 9(*a*) to 9(*c*), when the temperature Th of the fixing roller 131 is 250° C., the hot offset to the fixing roller 131 starts occurring. Therefore, according to Formula (8), the temperature of the toner on the surface of the printing sheet when the hot offset starts occurring is 194° C.

This temperature of the toner is substantially the same as the temperature (190° C., see FIGS. 8(*a*) to 8(*c*)) of the toner when the toner T, adhered to the pressure roller 132, offsets to the fixing roller 131. Therefore, the transfer of the toner T, adhered to the pressure roller 132, to the fixing roller 131 can be regarded as one of the hot offset phenomena.

According to the results obtained from the foregoing description, to prevent the transfer of the toner T, adhered to the surface of the pressure roller 132, to the fixing roller 131, the temperature of the pressure roller 132 may be set so that the temperature of the toner T adhered to the surface of the pressure roller 132 Oust after passing through the fixing nip portion Y) is a certain temperature at which the hot offset does not occur, or lower.

That is, where the temperature (a hot offset occurring boundary temperature of the fixing roller 131) of the fixing roller 131 when the hot offset starts occurring is Thh, a temperature (the temperature of the toner when the hot offset starts occurring) Tt4' of the toner on the surface of the printing sheet when the hot offset starts occurring can be shown by Formula (9) below in accordance with Formula (8).

$$Tt4'=0.776Thh \tag{9}$$

Here, in view of the fact that the transfer of the toner T, adhered to the pressure roller 132, to the fixing roller 131 can be regarded as one of the hot offset phenomena, the relation between (i) a temperature Tt3' of the toner when the transfer from the pressure roller 132 to the fixing roller 131 starts occurring and (ii) the temperature Tt4' of the toner when the hot offset starts occurring can be shown by Formula (10) below.

$$Tt3'=Tt4' \tag{4}$$

Further, where the temperature of the pressure roller 132 when the transfer of the toner T, adhered to the pressure roller 132, to the fixing roller 131 starts occurring is Tp', Tp' can be shown by Formula (11) below in accordance with Formulas (10), (7), and (9).

$$Tt3'=(Th+Tp')/2=0.776Thh \therefore Tp'=1.552Thh-Th \tag{11}$$

With this, to prevent the transfer of the toner T, adhered to the pressure roller 132, to the fixing roller 131, the temperature Tp of the pressure roller 132 may be controlled in accordance with Formula (12) below.

$$\therefore Tp \leqq 1.552Thh-Th \tag{12}$$

In view of the fact that, in FIGS. 9(*a*) to 9(*c*), the hot offset does not occur when the temperature of the fixing roller 131 is 240° C. but occurs when the temperature of the fixing roller 131 is 250° C., the hot offset occurring boundary temperature Thh of the fixing roller 131 may be 245° C. that is between 240° C. and 250° C.

As above, to prevent (i) the transfer of the toner T, adhered to the back of the printing sheet, to the pressure roller 132 and (ii) the transfer of the toner T, adhered to the surface of the pressure roller 132, to the fixing roller 131, the temperature Tp (° C.) of the pressure roller 132 may be controlled in accordance with Formula (13) below.

$$0.669Thc+53.4 \leqq Tp \leqq 1.552Thh-Th \quad (13)$$

In Formula (13), Thc denotes the cold offset occurring boundary temperature (the temperature of the fixing roller 131 when the cold offset starts occurring) (° C.) of the fixing roller 131, Thh denotes the hot offset occurring boundary temperature (the temperature of the fixing roller 131 when the hot offset starts occurring) (° C.) of the fixing roller 131, and Th denotes the temperature (° C.) of the fixing roller 131.

(Control Sequence of Fixing Device)

The following will explain control sequences of the fixing device in reference to FIGS. 12(*a*), 12(*b*), 25(*a*), and 25(*b*), and the control sequence of the fixing device is for controlling the temperature of the pressure roller 132 to be in a predetermined range described above.

First, the following will discuss a most appropriate control sequence in a warm-up and in a return from a sleep mode.

In the warm-up and in the return from the sleep mode, the printing sheet(s) is not fed. Therefore, there is concern that the temperature of the pressure roller 132 becomes too high, the toner T adhered to the pressure roller 132 transfers to the fixing roller 131, and the toner contaminates the image surface of the first printing sheet fed just after the warm-up is completed.

Especially, the pressure roller 132 is rapidly heated and the surface temperature thereof is increased by a heating action of the external heating means, such as the external heating roller 133.

Conventionally, in the warm-up and in the return from the sleep mode, the control sequences shown in FIGS. 25(*a*) and 25(*b*) are usually used to complete a return to a temperature, at which fixing can be carried out, in a shorter period of time. Here, FIGS. 25(*a*) and 25(*b*) show conventional control sequences. FIG. 25(*a*) shows a relation between the temperatures of respective rollers (the fixing roller 131, the pressure roller 132, and the external heating roller 133) and a time elapsed from start of driving of the fixing device, and FIG. 25(*b*) shows states of the fixing roller 131 and the external heating roller 133 in respective sequences.

As shown in FIGS. 25(*a*) and 25(*b*), conventional control sequences are as follows.

[1] With the respective rollers stopped, a heat source of the fixing roller 131 is turned on, and the fixing roller 131 is increased in temperature (A-1). Note that the fixing roller 131 is larger in the heat capacity and slower in the temperature rising speed than the external heating roller 133.

[2] After the fixing roller 131 reaches a predetermined temperature (150° C., here), the respective rollers start driving, and the pressure roller 132 is increased in temperature by heat transfer from the fixing roller 131 (A-2).

[3] After the fixing roller returns to a control temperature (200° C., here), the heat source of the external heating roller 133 is turned on, and the external heating roller is increased in temperature (A-3).

[4] After the external heating roller 133 returns to a control temperature (200° C., here), the feeding of the printing sheet(s) is started (B).

However, in the case of carrying out the warm-up or the return from the sleep mode by such control sequences, it becomes difficult to control the temperature Tp of the pressure roller 132 so that Formula (12) is satisfied, since the temperature rising speed of the pressure roller 132 is too high when the heat source of the external heating roller 133 is turned on (A-3), as shown in FIGS. 25(*a*) and 25(*b*).

That is, as shown in FIGS. 5(*a*) to 5(*c*) and FIGS. 9(*a*) to 9(*c*), the cold offset occurring boundary temperature Thc is 125° C., and the hot offset occurring boundary temperature Thh is 245° C. in the present embodiment. Therefore, in the case in which the temperature Th of the fixing roller 131 is 200° C. when the sheet feeding is started, the lower limit and upper limit of the temperature Tp of the pressure roller 132 can be obtained as follows by Formula (13).

$0.669Thc+53.4=137$ (the lower limit of the temperature $Tp$ of the pressure roller 132)

$0.552Thh-Th=180$ (the upper limit of the temperature $Tp$ of the pressure roller 132)

However, in the above-described conventional sequences, the temperature Tp of the pressure roller 132 just before the sheet feeding is started is 182° C. Therefore, in the case in which the toner T adheres to the pressure roller 132, the toner T transfers to the fixing roller 131, and contaminates the image surface of the first printing sheet fed just after the sheet feeding is started.

Moreover, if a responsive temperature sensor is provided to the pressure roller 132 to prevent this contamination, the configuration and the control sequences become complex, and the cost is increased.

Here, the fixing device 23 of the present embodiment carries out the control sequences shown in FIGS. 12(*a*) and 12(*b*). FIGS. 12(*a*) and 12(*b*) show the control sequences of the present embodiment. FIG. 12(*a*) shows a relation between the temperatures of respective rollers (the fixing roller 131, the pressure roller 132, and the external heating roller 133) and a time elapsed from start of driving of the fixing device 23, and FIG. 12(*b*) shows states of the fixing roller 131 and the external heating roller 133 in respective sequences.

As shown in FIGS. 12(*a*) and 12(*b*), the control sequences of the present embodiment are as follows.

[1] With the respective rollers stopped, a heat source of the fixing roller 131 is turned on, and the fixing roller is increased in temperature (A-1). Note that the fixing roller 131 is larger in the heat capacity and slower in the temperature rising speed than the external heating roller 133.

[2] After the fixing roller 131 reaches a predetermined temperature (150° C., here), the fixing device 23 starts rotating, and the pressure roller 132 is increased in temperature by heat transfer from the fixing roller 131 (A-2).

[3] After the fixing roller 131 returns to a control temperature (200° C., here), the heat source of the external heating roller 133 is turned on, and simultaneously the feeding of the printing sheet P is started (B).

That is, conventionally, the heat source of the external heating roller 133 is turned on in the warm-up (A-3), and the sheet feeding is started after the external heating roller 133 returns to the control temperature. However, in the present embodiment, the heat source of the external heating roller 133 is turned off in the warm-up, and the heat source is turned on and simultaneously the sheet feeding is started.

By the above-described control sequences, it is possible to avoid such a problem that the temperature of the pressure roller 132 rapidly increases from when the external heating roller 133 is turned on until when the sheet feeding is started. In addition, it is also possible to prevent the transfer of the toner T from the pressure roller 132 to the fixing roller 131 since the temperature Tp of the pressure roller 132 just before the sheet feeding is started is 165° C. (<180° C.) (see and compare respective changes in temperature of the pressure roller 132 from 80 seconds to 100 seconds from the start of the warm-up in FIGS. 12(*a*), 12(*b*), 25(*a*), and 25(*b*)).

Meanwhile, according to FIGS. 12(*a*) and 12(*b*), the temperature of the pressure roller 132 is in a range from 137° C. to 180° C. while feeding sheets (B). Therefore, it is possible to prevent such a problem that the toner T adhered to the back of the printing sheet offsets to the pressure roller 132, or to prevent such a problem that the toner T adhered to the pressure roller 132 at an interval between sheets transfers to the fixing roller 131.

(Post-Rotation after Finishing Sheet Feeding)

The following will discuss a most appropriate sequence in a post-rotation that is a rotation carried out after finishing the sheet feeding.

Even if the pressure roller 132 is controlled to a most appropriate temperature while the sheets are fed, there is a possibility that the sheet is contaminated by the toner T due to, for example, (i) variations in, for example, an environmental condition, an initial temperature of the printing sheet P, and a humidity, and (ii) an aging of the surface of the pressure roller 132.

Here, it is desirable to form such a sequence that, in the post-rotation, the toner adhered to the pressure roller 132 is cleaned by the cleaning roller 140 provided for the pressure roller 132.

The effect of cleaning by the cleaning roller 140 is high when the toner is sufficiently melted, and is decreased when the toner aggregates and solidifies. Therefore, as shown in FIG. 1, the cleaning roller 140 of the present embodiment is provided downstream of the external heating roller 133 so as to contact the surface of the pressure roller 132.

With this, the toner T adhered to the surface of the pressure roller 132 is heated by the external heating roller 133. Therefore, the effect of cleaning by the cleaning roller 140 is enhanced.

Moreover, the toner T adhered to the pressure roller 132 may adhere to or be deposited on the external heating roller 133, and the toner T adhered to the external heating roller 133 may be transferred again to the pressure roller 132. However, since the cleaning roller 140 is provided downstream of the external heating roller 133 in the present embodiment, the toner T can be collected by the cleaning roller 140. Therefore, it is possible to prevent the toner T, transferred again from the external heating roller 133 to the pressure roller 132, from contaminating the back of the printing sheet.

To effectively carry out the cleaning of the toner T, adhered to the pressure roller 132, by the cleaning roller 140 in the post-rotation, as shown in C of FIG. 25(*b*), conventionally, the temperatures of the fixing roller 131 and external heating roller 133 are controlled to be the same as the temperatures (200° C., here) when the sheets are fed, and with such temperatures, the toner T adhered to the surface of the pressure roller 132 is heated, melted, and collected.

However, as shown in C of FIG. 25(*b*), the temperature of the pressure roller 132 in the post-rotation becomes 183° C. in this conventional cleaning sequence, that is, the temperature of the pressure roller 132 in the post-rotation becomes 180° C., which is a temperature at which the transfer of the toner to the fixing roller 131 starts occurring, or higher. Specifically, if one-time cleaning by the cleaning roller 140 cannot clean the toner completely, there is a possibility that the remaining toner transfers to the fixing roller 131 and contaminates the image surface of the first printing sheet in the following job.

Here, in the cleaning sequence of the post-rotation of the present embodiment, as shown in FIGS. 12(*a*) and 12(*b*), the heat source of the fixing roller 131 is turned off, the temperature of the external heating roller 133 is controlled to 180° C., and the cleaning by idling is carried out for about 5 seconds to 10 seconds.

The temperature of the pressure roller in this case is about 171° C. (see C of FIG. 12(*a*)), and the temperature of the fixing roller 131 decreases from 200° C. Therefore, it is possible to effectively prevent the toner from transferring to the fixing roller 131. In addition, the temperature of the external heating roller 133 is kept at about 180° C. (see C of FIG. 12(*a*)), and the toner T adhered to the surface of the pressure roller 132 can be sufficiently heated and melted. Therefore, the effect of cleaning by the cleaning roller 140 can be obtained adequately.

(Feeding of Small-Size Sheet)

The following will discuss a control method used when a small-size sheet is fed.

In a conventional and commonly-used fixing device, when feeding a printing sheet whose width is shorter than the width of the fixing roller 131, such as a vertically-fed A4-size sheet, a vertically-fed B5-size sheet, a postcard, an envelope, etc., there is a problem in that a portion (no-sheet-contacting portion) of the fixing roller 131 which portion positions outside the width of the printing sheet and a portion (no-sheet-contacting portion) of the pressure roller 132 which portion positions outside the width of the printing sheet are abnormally increased in temperature, that is, a no-sheet-contacting portion abnormal temperature rising occurs.

If the no-sheet-contacting portion temperature rising occurs due to the continuous feeding of the small-size sheets in the fixing device 23 of the present embodiment, not only the no-sheet-contacting portion of the fixing roller 131 but also the no-sheet-contacting portion of the pressure roller 132 is abnormally increased in temperature. Therefore, it becomes difficult to control the temperature of the pressure roller 132 in accordance with Formula (12), that is, it becomes difficult to control the temperature of the pressure roller 132 so that the transfer of the toner from the back of the printing sheet to the pressure roller 132 does not occur or the transfer of the toner from the pressure roller 132 to the fixing roller 131 does not occur.

Here, an experiment was carried out to measure the temperatures of the fixing roller 131 and pressure roller 132 under such a condition that 100 B5-size printing sheets P were fed continuously at a rate (sheet feeding rate) of 40 sheets per minute. Note that the B5-size printing sheet is conditionally the most difficult sheet among the small-size sheets in view of the no-sheet-contacting portion temperature rising.

In this experiment, (i) used as Comparative Example X was a fixing device which includes neither the external heating roller 133 nor the cleaning roller 140, (ii) used as Comparative Example Y was a fixing device which includes the external heating roller 133 and the cleaning roller 140, and controls the temperature of the external heating roller 133 to 200° C. while sheets are fed, and (iii) used as the present embodiment was the fixing device 23 which includes the external heating roller 133 and the cleaning roller 140, and turns off the heat source (the heater lamp) of the external heating roller 133 while sheets are fed. The following will discuss Comparative Examples X and Y and the present embodiment. FIGS. 13(*a*) to 13(*c*) and 14 show results of this experiment. FIG. 13(*a*) shows a relation in the present embodiment between a position (a center line is 0) in a longitudinal direction of the printing sheet P and a temperature of a roller (the fixing roller 131 or the pressure roller 132) contacting the position. FIGS. 13(*b*) and 13(*c*) respectively show the relation in Comparative Example X and the relation in Comparative Example Y. FIG.

14 shows respective conditions and occurrence or nonoccurrence of the transfer of toner in Comparative Examples X and Y and the present embodiment.

As shown in FIG. 13(*b*), in Comparative Example X, since the external heating roller 133 does not heat the pressure roller 132, a sheet-contacting portion of the pressure roller 132 is increased in temperature up to only 131.2° C., and as a result, the transfer of the toner T, adhered to the back of the printing sheet, to the pressure roller occurs.

Moreover, since the no-sheet-contacting portion of the pressure roller 132 is increased in temperature up to 194.8° C. due to the no-sheet-contacting portion abnormal temperature rising, the transfer of the toner T, adhered to the pressure roller 132, to the fixing roller 131 occurs.

In Comparative Example Y, the external heating roller 133 heats the pressure roller 132, the sheet-contacting portion of the pressure roller 132 is increased in temperature up to 153.9° C., and as a result, the toner T adhered to the back of the printing sheet does not transfer to the pressure roller 132.

As compared with Comparative Example X, the no-sheet-contacting portion temperature rising is suppressed due to a heat equalization (since the external heating roller 133 and the cleaning roller 140 are made of aluminum which excels in heat conductivity, the heat of the no-sheet-contacting portion of the pressure roller 132 moves to the sheet contacting portion of the pressure roller 132 via the external heating roller 133 and the cleaning roller 140. This equalizes temperature variations in the pressure roller 132.) by the external heating roller 132 and the cleaning roller 140. However, since the heat is supplied from the external heating roller 133 to the pressure roller 132, the no-sheet-contacting portion of the pressure roller 132 is increased in temperature up to 181.1° C. As a result, the transfer of the toner T, adhered to the pressure roller 132, to the fixing roller 131 occurs.

As shown in FIG. 13(*a*), in the present embodiment, while sheets are fed, the heat source (the heater lamp 136) of the external heating roller 133 is turned off to stop the heat supply from the external heating roller 133 to the pressure roller 132. Thus, the temperature rising of the no-sheet-contacting portion of the pressure roller 132 is suppressed to 166.3° C. On this account, even when the small-size sheets are fed continuously, it is possible to prevent the transfer of the toner, adhered to the pressure roller 132, to the fixing roller 131.

Moreover, the sheet feeding rate of the small-size sheet is usually lower than that of a normal-size sheet. Therefore, even if the heat source of the external heating roller 133 is turned off, the temperature of the sheet-contacting portion of the pressure roller 132 is kept at 138.3° C., as shown in FIG. 13(*a*). On this account, it is possible to prevent the transfer of the toner T, adhered to the back of he printing sheet, to the pressure roller 132.

Note that in the present embodiment, the heat source (the heater lamp 136) of the external heating roller 133 is completely turned off. In this case, the temperature of the external heating roller 133 is kept at 150° C. by the heat supply from the pressure roller 132, and the temperature of the pressure roller 132 is 166.3° C. (see FIG. 13(*b*)).

Therefore, when feeding the small-size sheets, the temperature of the external heating roller 133 is decreased from 200° C. by, for example, reducing the power supply to the external heating roller 133 with the heat source remaining in an ON state, and as a result, the temperature of the pressure roller 132 may be controlled to be lower than a control temperature when the normal-size sheet is fed and to be a temperature (175.4° C. or lower in this case) at which the offset does not occur.

Note that the fixing device 23 of the present embodiment is not limited to the above-described configuration (see FIG. 1). For example, the fixing device 23 of the present embodiment may have the configuration shown in FIG. 16. The following will explain this configuration.

Since the same fixing roller 131 is used here, the explanation thereof is omitted. In addition, the same reference numerals are used for members having the same functions as the above-described members.

Figure 16:
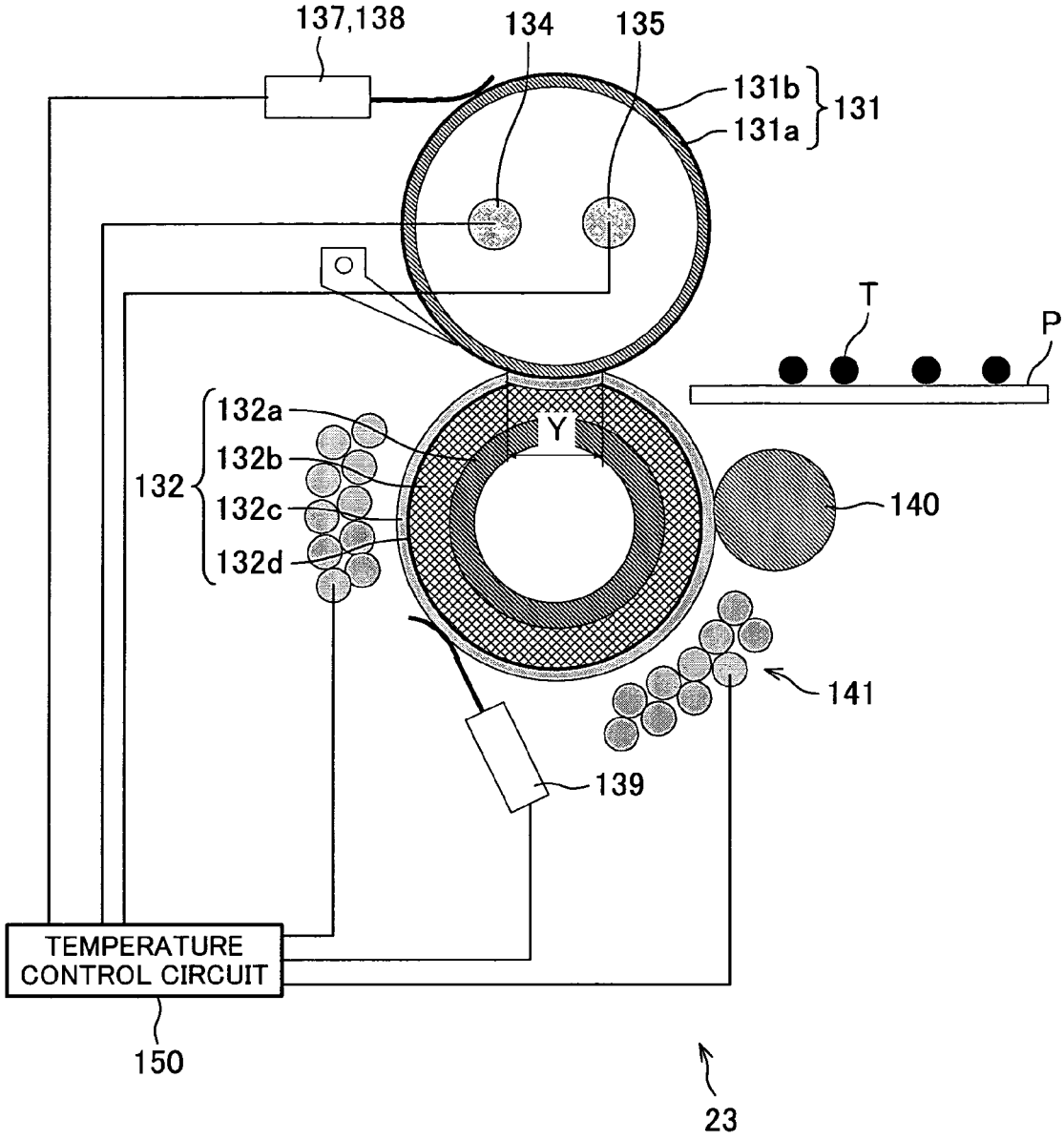
FIG. 16 is an explanatory diagram showing a cross section of another configuration of the fixing device of the embodiment.

As shown in FIG. 16, the fixing device 23 of the present configuration includes: the fixing roller 131 (first contacting member); the pressure roller 132 (second contacting member); an induction heating coil (external heat source) 141; heater lamps 134 and 135 which are heat sources for the fixing roller; temperature sensors 137 and 138 which detect the temperature of the fixing roller 131; a temperature sensor 139 which detects the temperature of the pressure roller 132; a cleaning roller 140; a control circuit (not shown); and an induction heating coil drive power source (not shown).

The heater lamps 134 and 135 are halogen heaters, and are provided inside the fixing roller 131. By energizing the heater lamps 134 and 135 by the control circuit, the heater lamps 134 and 135 emit light in accordance with a predetermined heat generation distribution and emit infrared light, so that an inner circumference surface of the fixing roller 131 is heated. Note that the rated outputs of the heater lamps 134 and 135 are 950 W in total.

The pressure roller 132 has the four-layer structure in which (i) a heat resistant elastic material layer 132*b*, such as silicon rubber, is provided on the surface of an outer peripheral surface of a core bar 132*a*, such as iron steel, stainless steel, aluminum, etc., (ii) a heat generating layer 132*d* is provided on the heat resistant elastic material layer 132*b*, and (iii) a release layer 132*c* is provided as an outermost layer.

Here, the heat resistant elastic layer 132*b* which has a thickness of 6 mm and is made of foam silicon rubber is formed on the core bar 132*a* which is made of metal, such as aluminum, iron, or stainless steel (to prevent heat generation due to induction heating, it is desirable to use aluminum), and has a diameter of 40 mm.

Moreover, the heat generating layer 132*d* is a heat generator which generates heat by induction heating. To shorten the mount of time for raising the surface temperature, the heat generating layer 132*d* is reduced in thickness to 40 μm to 50 μm.

Moreover, since the heat generating layer 132*d* is subjected to induction heating, a magnetized conductive member, such as iron, SUS430, or a stainless material, is used as the material of the heat generating layer 132*d*. Note that the material of the heat generating layer 132*d* is not limited to these, and a silicon steel plate, an electromagnetic steel plate, or a nickel steel plate may be used as long as the material has especially high relative magnetic permeability. Here, nickel which is made by electroforming and has a thickness of 40 μm is used.

If a material is a nonmagnetic material but has high resistance, such as an SUS304 stainless material, the material can be subjected to induction heating. Therefore, the material can be used as the material of the heat generating layer 132*d*. Further, if a material is a nonmagnetic base member (for example, ceramics) but the above-described material having the high relative magnetic permeability is combined with this material so that this combination has conductivity, this combination can be used as the heat generating layer 132*d*. Moreover, to increase the amount of generated heat, the heat generating layer may be made of a plurality of materials.

Moreover, the release layer 132*c* covers the surface (outer peripheral surface) of the heat generating layer 132*d*to prevent the toner T, whose viscosity is decreased since the toner T is heated at the nip portion Y, from adhering to the pressure roller 132. Used for the release layer 132*c*are, for example, (i) fluorocarbon resin, such as PTFE (polytetrafluoroethylene), PFA (copolymer of tetrafluoroethylene and perfluoroalkylvinylether), etc., and (ii) an elastic body, such as silicon rubber, fluorocarbon rubber, fluorosilicon rubber, etc. Note that the release layer 132*c* may be realized by a plurality of layers each made of the above resin or the elastic body.

The pressure roller 132 contacts the fixing roller 131 at a pressure of 274 N by a pressure member (not shown), such as a spring. With this, between the fixing roller 131 and the pressure roller 132, a fixing nip portion Y having the width of about 7 mm is formed.

In addition, as induction heating means of the pressure roller 132, the induction heating coil 141 is provided at, at least, one position adjacent to the outer peripheral surface of the pressure roller 132.

The induction heating coil 141 is so provided as to have a curvature and surround the outer peripheral surface of the pressure roller 132. Therefore, a magnetic flux(es) concentrates on the center of the induction heating coil 141, and the amount of eddy currents generated increases. As a result, it is possible to quickly raise the surface temperature of the pressure roller 132.

In view of heat resistance, used as the induction heating coil 141 here is an aluminum single wire covered by an insulating layer (for example, an oxide film). However, the induction heating coil 141 may be a copper wire, a copper-based composite member wire, or a litz wire (a stranded wire of, for example, an enamel wire). Regardless of the kinds of the wires, it is preferable that total resistance of the induction heating coil 141 be 0.5 Ω or less (desirably 0.1 Ω or less) to suppress Joule loss of the coil. Moreover, a plurality of the induction heating coils 141 may be provided in accordance with the size of the printing sheet P.

To the induction heating coil 141, a high-frequency current is supplied from an exciting circuit (not shown). Then, the pressure roller 132 is subjected to induction heating by an alternating magnetic field generated by the high-frequency current.

On the peripheral surface of the fixing roller 131, the thermistors 137 and 138 are provided as temperature detecting means. Similarly, on the peripheral surface of the pressure roller 132, the thermistor 139 is provided as temperature detecting means. With these, the surface temperatures of respective rollers are detected.

Then, on the basis of data of the temperatures detected by the thermistors 137 to 139, temperature control means controls energization of the heater lamps 134 and 135 and the induction heating coil 141 so that the temperature of each roller is a predetermined temperature.

According to the present configuration, it is possible to effectively heat a much larger area of the pressure roller 132. Therefore, as compared with a configuration using the external heating roller 133, it is possible to heat the surface of the pressure roller 132, more rapidly. On this account, it is possible to further improve the accuracy of the temperature control of the pressure roller 132. Further, since it is possible to provide such that the pressure roller 132 and the induction heating coil 141 does not contact each other, the induction heating coil 141 is not contaminated by, for example, the toner T or the paper strips.

(Configuration of Image Forming Apparatus)

Referring to FIGS. 17 to 24, the following will explain the configuration and functions of an image forming apparatus (copier) to which the above-described fixing device 23 is applied.

Figure 17:
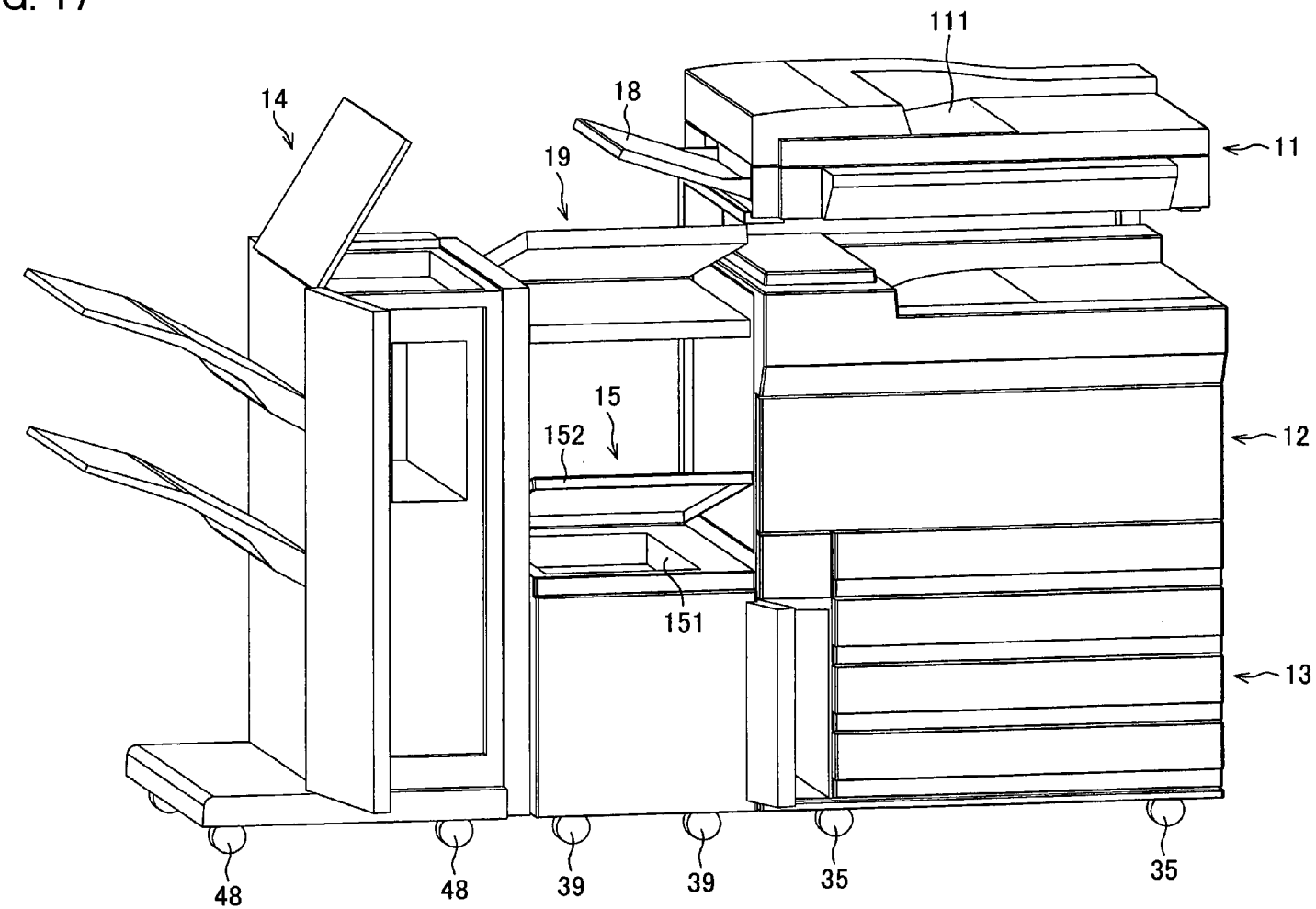
FIG. 17 is a perspective view of an image forming apparatus including the fixing device shown in FIG. 1.
Figure 18:
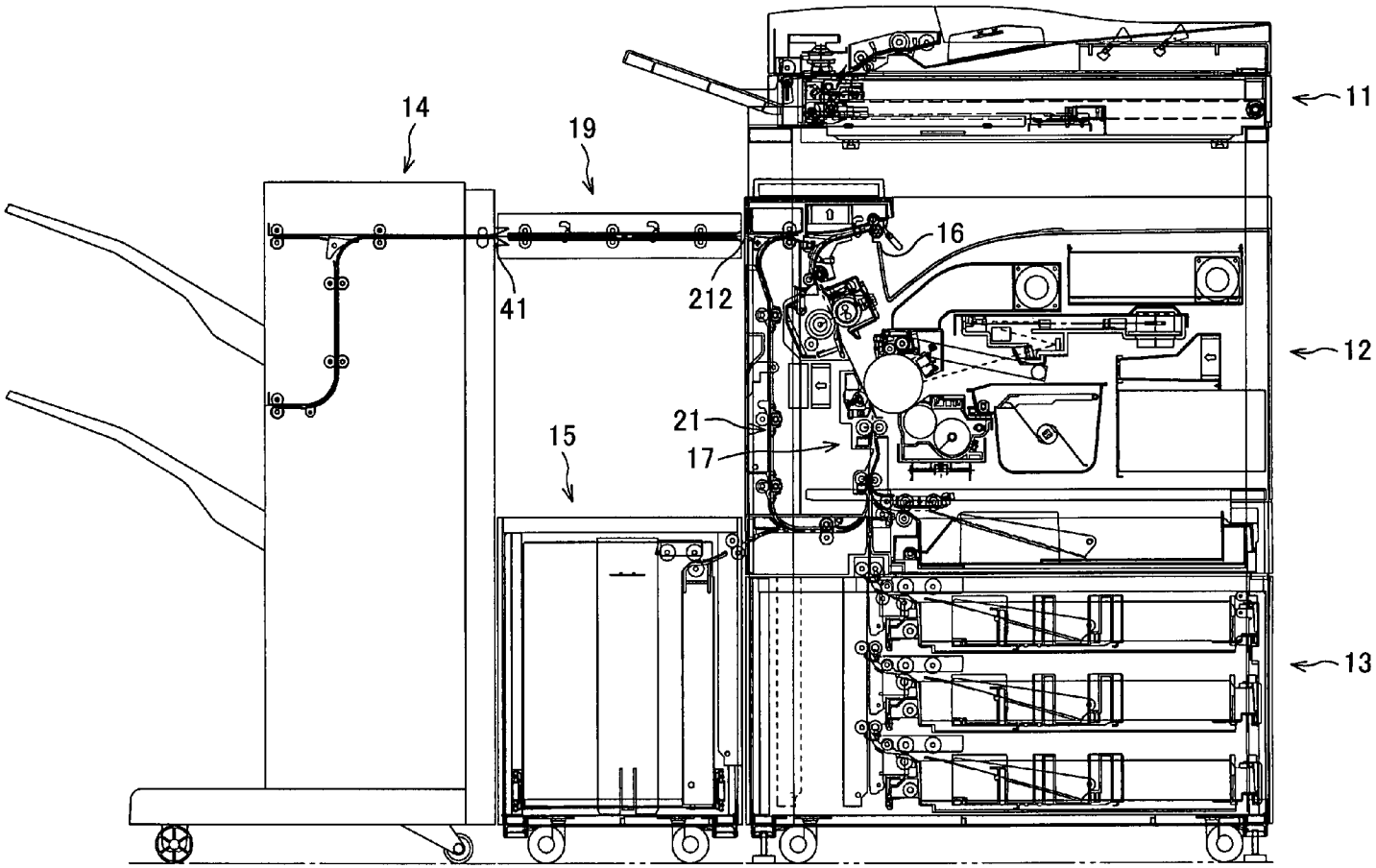
FIG. 18 is a diagram showing an internal configuration of the image forming apparatus.
Figure 20:
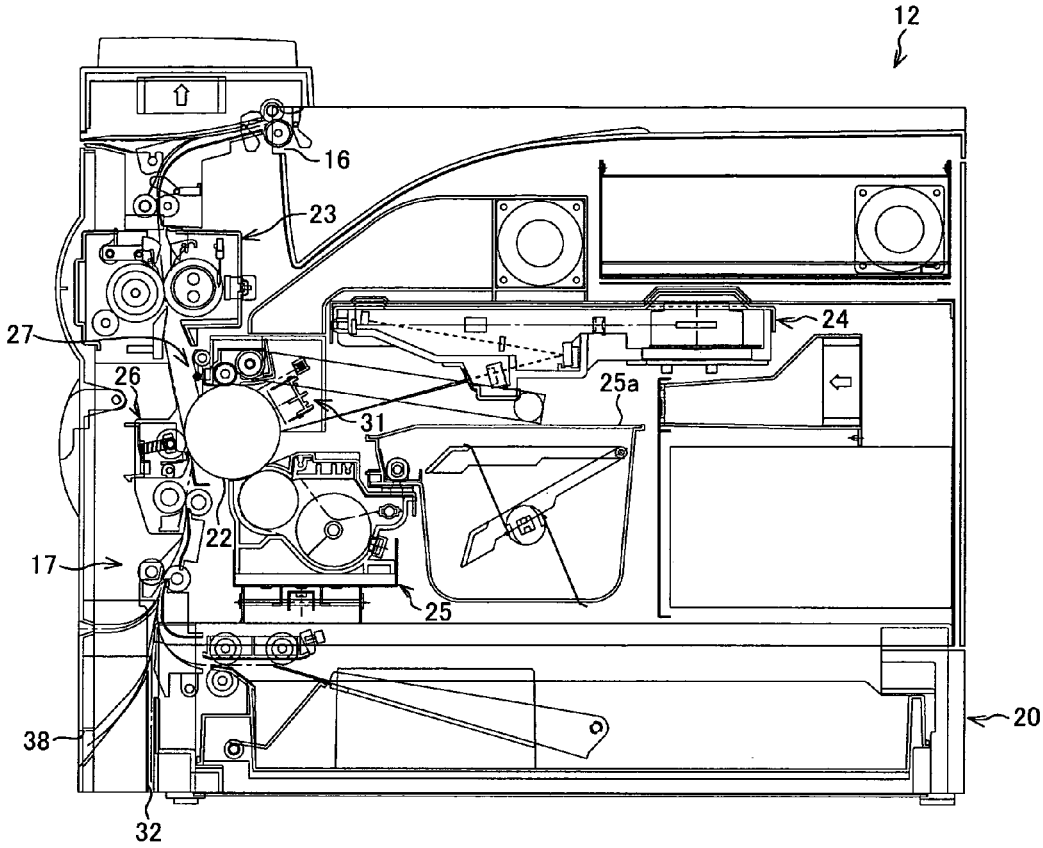
FIG. 20(*a*) is a diagram showing a configuration of an image printing device in the image forming apparatus.
Figure 20:
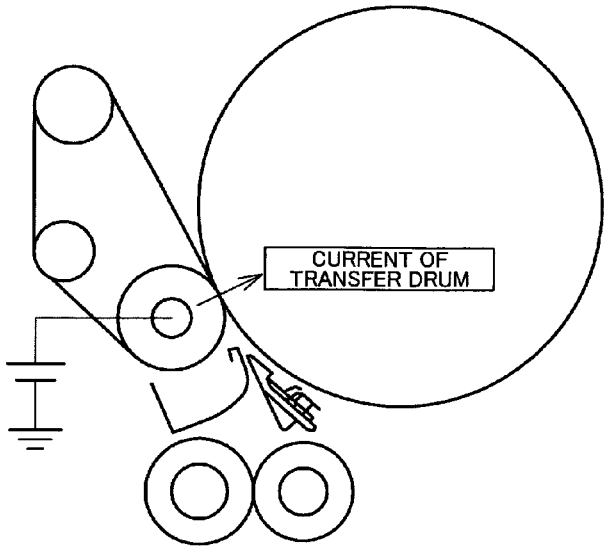

FIG. 17 is a perspective view of an appearance of the image forming apparatus, FIG. 18 is a diagram showing an internal configuration of the image forming apparatus, and FIG. 20(*a*) is a perspective view of an appearance of the image forming apparatus.

As shown in FIGS. 17 and 18, the image forming apparatus includes: a document image reading device 11; an image printing device 12; a printing medium feeding device 13; a post-processing device 14; and an external printing medium feeding device 15. As will be described later, the above-described fixing device 23 (see FIG. 20(*a*)) is included in the image printing device 12.

The image printing device 12 (image forming section) and the printing medium feeding device 13 (printing medium feeding section) form an image forming apparatus main body, such as a digital printer. As shown in FIG. 18, in the image forming apparatus main body, a conveying section 17 is provided for conveying the printing medium from the printing medium feeding device 13 through the image printing device 12 to a printing medium output section 16. Moreover, by further including the document image reading device 11 in the image forming apparatus main body, it is possible to construct a digital copier, a facsimile device, etc.

Figure 19:
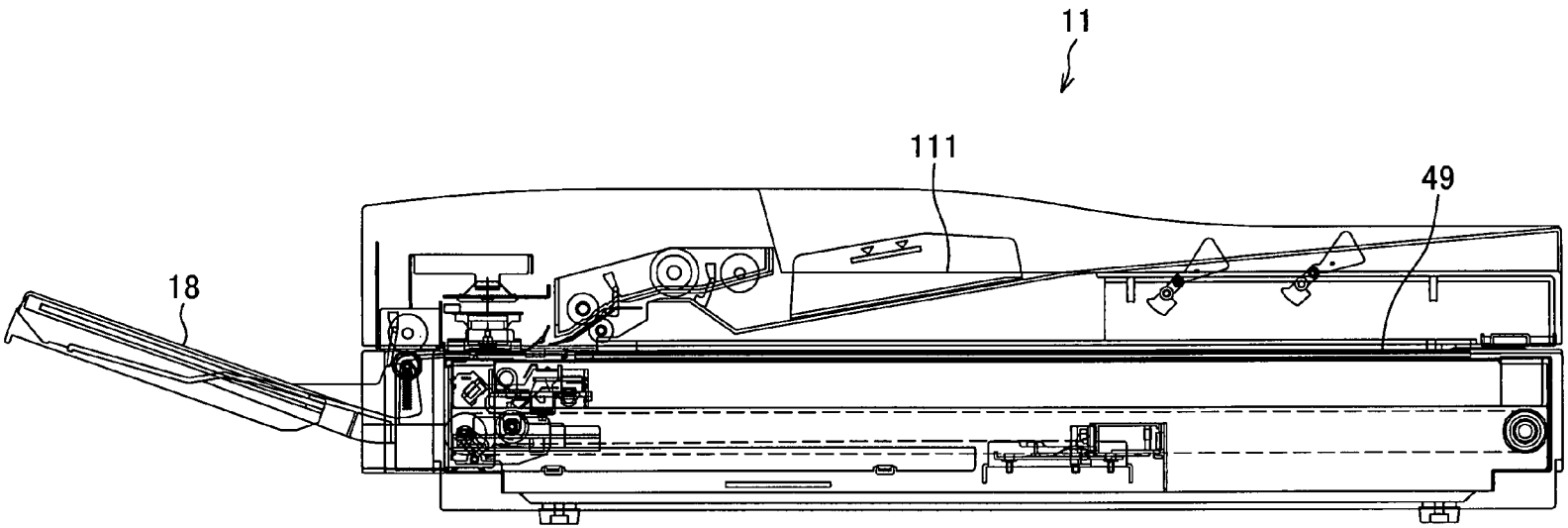
FIG. 19 is a diagram showing a configuration of a document image reading device in the image forming apparatus.

The following will explain operations of the image forming apparatus. FIG. 19 shows a configuration of the document image reading device 11.

First, the document image reading device 11 reads a document to obtain image data, and outputs the image data to the image printing device 12. The image printing device 12 carries out an appropriate image processing with respect to the inputted image data.

Meanwhile, sheet-like printing mediums (printing sheets), such as print sheets or OHP (Over Head Projector) sheets, are separately discharged one by one from the printing medium feeding device 13, and are conveyed to the image printing device 12 by the conveying section 17.

Then, the image printing device 12 forms (prints) on the printing medium an image based on the image data. The printing medium on which the image is printed is conveyed to the printing medium output section 16 by the conveying section 17, and is output outside the image forming apparatus.

As shown in FIG. 19, a document tray 18 that is a document feeding section or a document collecting section is attached to the document image reading device 11.

When the document tray 18 functions as the document feeding section, a set of documents are placed on the document tray 18. In this case, the document tray 18 can separately feed the documents one by one continuously to a reading section.

Meanwhile, when the document tray 18 functions as the document collecting section, the document tray 18 receives and holds the documents which are read and output continuously.

In the case of printing plural sets of documents and outputting those printing mediums on the printing medium output section 16, the printing mediums are mixed (for example, the printing mediums on which the same page is printed are continuously output). Therefore, a user needs to sort the printing mediums after printing.

Here, as shown in FIG. 18, the post-processing device 14 is attached to the image forming apparatus main body. With this, it is possible to, for example, separately output the printing mediums to a plurality of output trays so that the printing mediums are not mixed. Moreover, the image forming apparatus main body and the post-processing device 14 are provided with a predetermined distance therebetween, so that a space is provided between the image forming apparatus main body and the post-processing device 14.

Note that the image forming apparatus main body and the post-processing device 14 are connected with each other by an external conveying section 19, and the printing medium on which an image is formed is conveyed form the conveying section 17 through the external conveying section 19 to the post-processing device 14.

Moreover, in view of energy saving and cost saving, there is a demand for a function of printing an image(s) on both sides of the printing sheet, such as a print sheet. This function can be realized by a two-sided printing conveying section 21 which turns over the printing medium on one side of which an image is formed and then conveys the printing medium again to the image printing device 12.

The printing medium on one side of which an image is formed is conveyed not to the printing medium output section 16 or the post-processing device 14 but to the two-sided printing conveying section 21, and the printing medium is turned over by the two-sided printing conveying section 21. Then, the printing medium is again conveyed to an electrophotographic process section (will be described later) of the image printing device 12. The image printing device 12 prints an image on another side on which an image is not printed. In this way, a two-sided printing can be realized.

Further, if a user wants to use a printing medium which cannot be held by the printing medium feeding device 13, or if a user wants to use the printing mediums the number of which exceeds the number which can be held by the printing medium feeding device 13, an external printing medium feeding device 15 is attached to the image forming apparatus main body as a peripheral device for function enhancement. In this way, the desired printing medium and the desired number of printing mediums can be used by storing those in the external printing medium feeding device 15.

The following will explain in detail respective devices and portions of the image forming apparatus.

FIG. 20(*a*) is a diagram showing a configuration of the image printing device 12. As shown in FIG. 20(*a*), the electrophotographic process section including a photosensitive drum at the center thereof is placed on substantially the center left side of the image printing device 12.

The electrophotographic process section is configured such that the photosensitive drum 22 is provided at the center thereof, and for example (i) an electrifying unit 31 which uniformly electrifies the surface of the photosensitive drum 22, (ii) a light scanning unit 24 which forms an optical image on the photosensitive drum 22, which is uniformly electrified, to write an electrostatic latent image on the photosensitive drum 22, (iii) a development unit 25 which develops by using a developer the electrostatic latent image written by the light scanning unit 24, (iv) a transfer unit 26 which transfers to the printing medium an image recorded and developed on the surface of the photosensitive drum 22, and (v) a cleaning unit 27 which removes the developer remained on the surface of the photosensitive drum 22 to allow a new image to be formed are sequentially provided around the photosensitive drum 22.

The fixing device 23 is provided above the electrophotographic process section (image transfer device). The fixing device 23 sequentially receives the printing medium(s) to which an image is transferred by the transfer unit 26, and heats the developer (toner T), transferred onto the printing sheet, to fix the developer.

The printing medium on which an image is printed is placed face down (the surface on which the image is formed (printed surface) is placed face down) and is output from the printing medium output section 16 provided at an upper area of the image printing device 12. Note that the remaining developer removed by the cleaning unit 27 is collected and restored in a developer supplying section 25*a*of the development unit 25, so as to be reused.

At a lower area of the image printing device 12, a printing medium feeding section 20 is provided to store the printing mediums. The printing medium feeding section 20 separately feeds the printing mediums one by one to the electrophotographic process section.

The conveying section 17 includes a plurality of rollers and guides. The printing medium is fed from the printing medium feeding section 20 and passes through a first feeding path which is defined by a space between the rollers, a space between the guides, a space between the photosensitive drum 22 and the transfer unit 26, etc. After an image is printed on the printing medium, the printing medium passes through a second feeding path which is defines by a space between the rollers, a space between the guides, a space between the rollers of the fixing device 23, etc. Then, the printing medium is output to the printing medium output section 16.

When placing the printing medium(s) in the printing medium feeding section 20, a printing medium storing tray is pulled out in a direction orthogonal to a conveying direction of the image printing device 12, that is, the printing medium storing tray is pulled out to the front side. Then, the printing mediums are placed or replaced.

In addition, on a lower surface of the image printing device 12, a printing medium receiving section 32 is provided to (i) receive the printing mediums sent from the printing medium feeding device 13 that is an additional unit and (ii) sequentially feed the printing mediums toward a space between the photosensitive drum 22 and the transfer unit 26.

Further, provided at a space around the light scanning unit 24 are, for example, (i) a process control unit (PCU) substrate for controlling the electrophotographic process section, (ii) an interface substrate for receiving image data from the outside of the image printing device 12, (iii) an image control unit (ICU) substrate for carrying out a predetermined image processing with respect to the image data received from the interface substrate and the image data read by the document image reading device 11, so as to cause the light scanning unit to scan and record the image data as an image, and (iv) a power source unit for supplying electric power to respective substrates and units.

Note that the image printing device 12 itself can be connected with an external device, such as a personal computer, via the interface substrate, so as to be used as a printer for forming on the printing medium an image data supplied from the external device.

In the foregoing explanation, only one printing medium feeding section 20 is included in the image printing device 12, however the present embodiment is not limited to this. For example, one or more printing medium feeding sections can be included in the image printing device 12.

Figure 21:
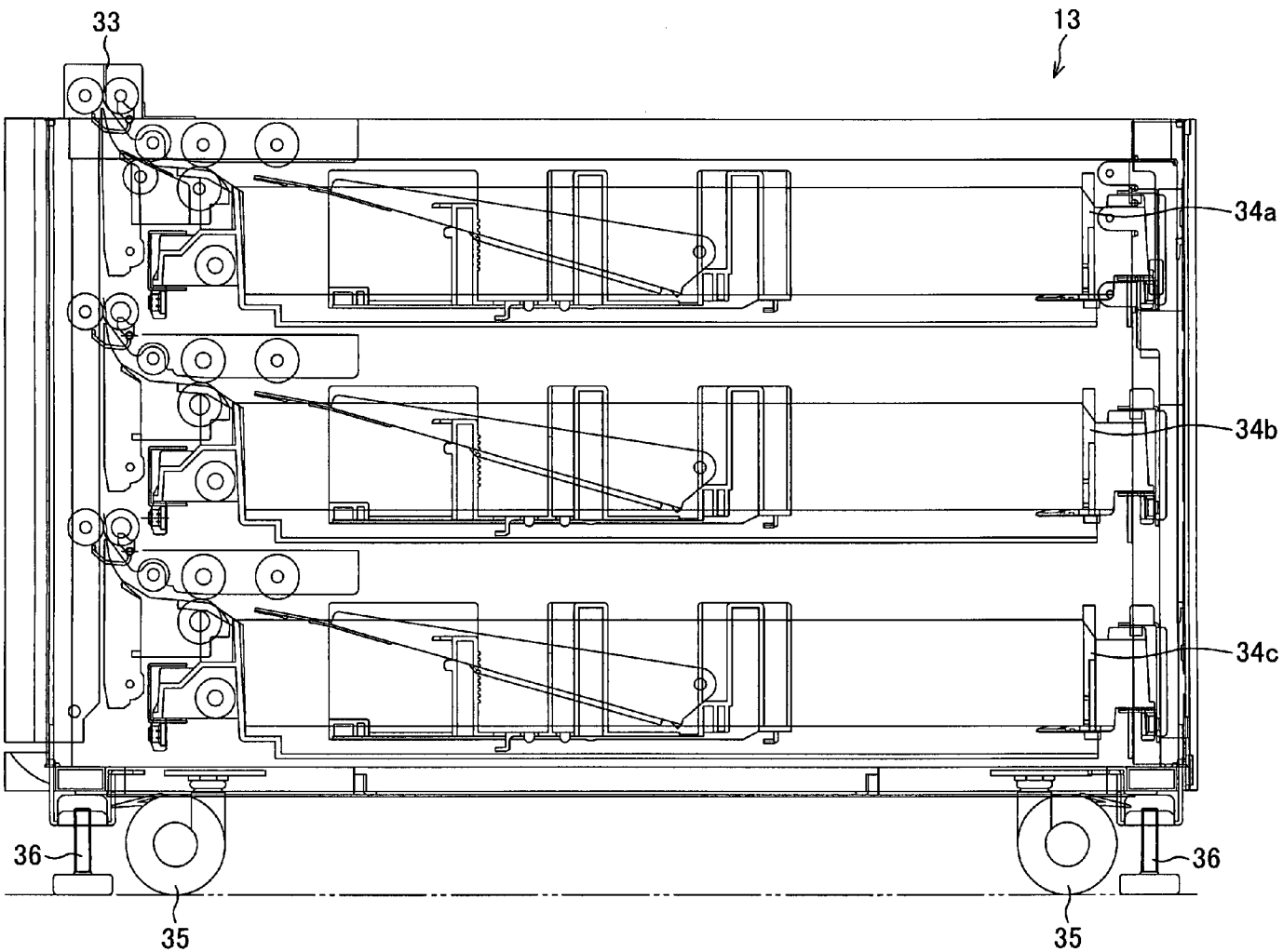
FIG. 21 is a diagram showing a configuration of a printing medium feeding device in the image forming apparatus.

FIG. 21 is a cross sectional diagram showing a configuration of the printing medium feeding device 13 that is an additional unit. The printing medium feeding section 13 can be added as a part of the image printing device 12 when, for example, the number of printing mediums in the printing medium feeding section 20 is not enough.

The printing medium feeding device 13 can store larger printing mediums than the printing medium feeding section 20. The printing medium feeding device 13 separates the stored printing mediums one by one, and discharges the printing medium toward a printing medium output section 33 provided on an upper surface of the printing medium feeding device 13.

The printing medium feeding device 13 includes three trays that are printing medium storing trays 34*a*, 34*b*, and 34*c*. From the printing medium storing trays 34*a*, 34*b*, and 34*c* which are stacked, one printing medium storing tray in which the desired printing medium is stored is selectively operated by, for example, PCU, and thus the printing medium feeding device 13 separately discharges the printing mediums.

The discharged printing medium proceeds from the printing medium output section 33 through a printing medium receiving section 32, provided at an lower area of the image printing device 12, to the electrophotographic process section. When placing the printing medium(s) in the printing medium feeding device 13, any of the printing medium storing trays 34*a*, 34*b*, and 35*c* is pulled out to the front side. Then, the printing mediums are placed or replaced.

In the foregoing explanation, three printing medium storing trays 34*a*, 34*b*, and 34*c* are stacked, however the number of trays can be, for example, at least one, or three or more.

Note that a plurality of wheels 35 are provided on a lower surface of the printing medium feeding device 13, so that the image forming apparatus main body including the printing medium feeding device 13 can be easily moved in the case of expansion. Moreover, it can be fixed at an installation location by a stopper 36.

Figure 22:
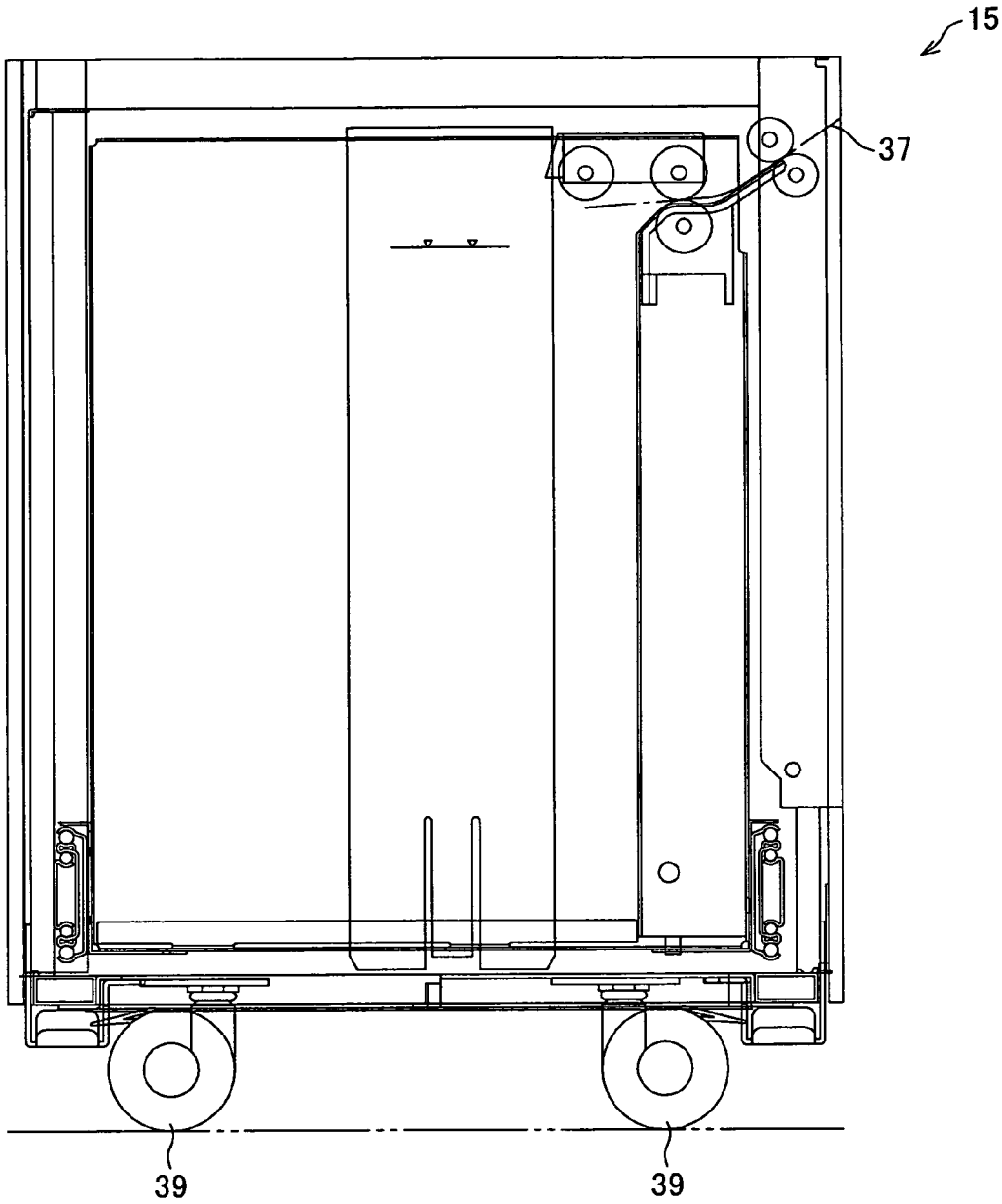
FIG. 22 is a diagram showing a configuration of an external printing medium feeding device in the image forming apparatus.

FIG. 22 is a diagram showing a configuration of the external printing medium feeding device 15. The external printing medium feeding device 15 can hold the printing medium which cannot be held by the printing medium feeding device 13 included in the image printing device 12 and can hold the printing mediums the number of which exceeds the number which can be held by the printing medium feeding device 13 included in the image printing device 12. In addition, the external printing medium feeding device 15 separates the stored printing mediums one by one, and discharges the printing medium toward a printing medium output section 37 provided at an upper portion of a right side surface of the external printing medium feeding device 15.

The printing medium discharged from the printing medium output section 37 is transferred to an external printing medium receiving section 38 (see FIG. 20(*a*)) provided at a lower portion of the left side surface of the image printing device 12.

In the external printing medium feeding device 15, the printing medium(s) is placed or replaced through an inserting opening 151 (shown in FIG. 17) formed on an upper portion of the external printing medium feeding device 15. In addition, the inserting opening 151 is provided with a lid 152 which is openable and closable. The inserting opening may be closed unless the printing medium is placed or replaced.

Note that a plurality of wheels 39 are provided on a lower surface of the external printing medium feeding device 15, so that the external printing medium feeding device 15 can be easily moved in the case of expansion. Moreover, the external printing medium feeding device 15 can be fixed at an installation location by a stopper.

Figure 23:
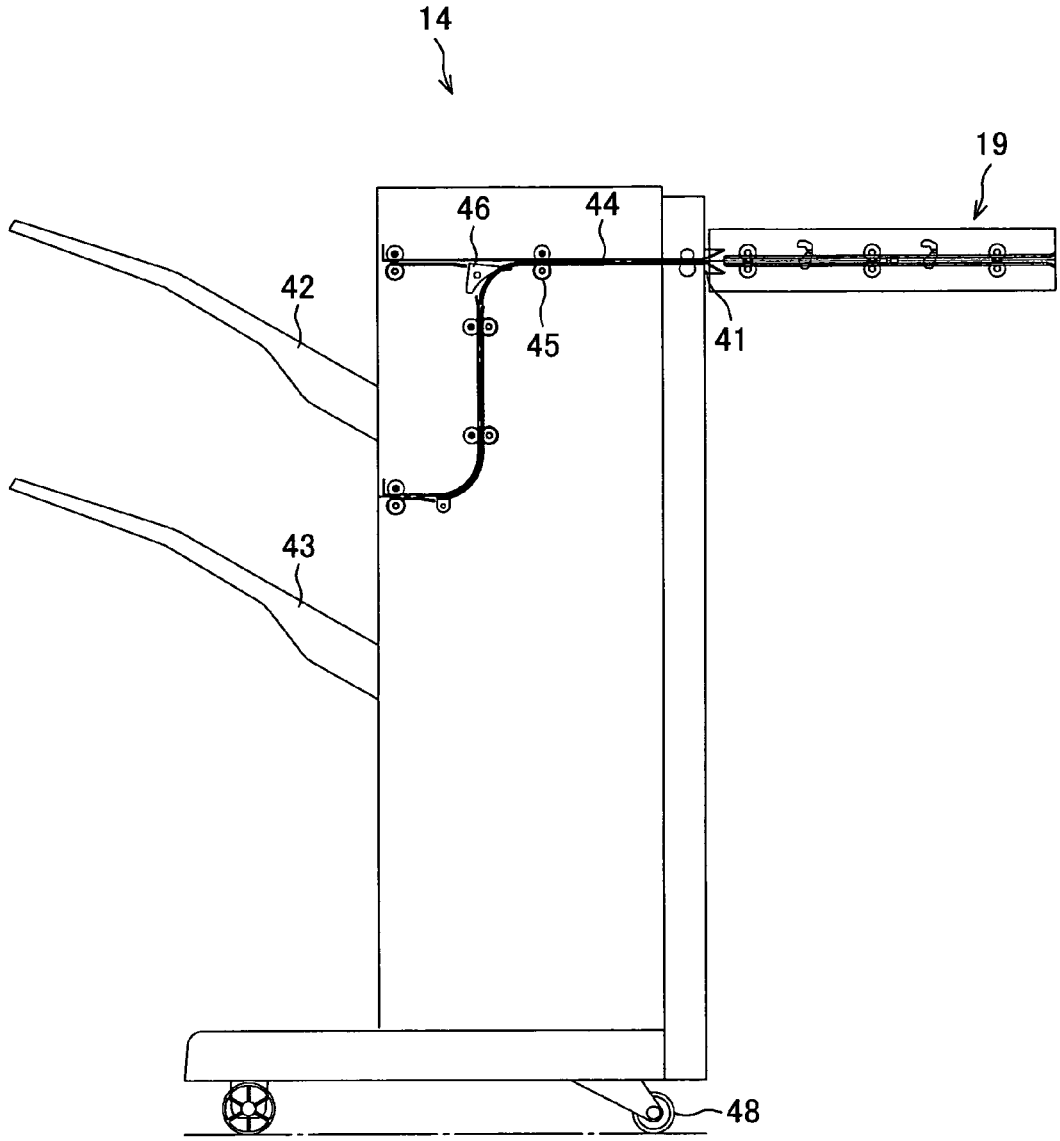
FIG. 23 is a diagram showing a configuration of a post-processing device in the image forming apparatus.

FIG. 23 is a diagram showing a configuration of the post-processing device 14. As shown in FIG. 23, the post-processing device 14 and the image forming apparatus main body are provided with a predetermined distance therebetween. The post-processing device 14 and the image forming apparatus main body are connected with each other by the external conveying section 19. The printing medium on which an image is printed by the image forming apparatus main body is conveyed through the external conveying section 19 to the post-processing device 14.

As shown in FIG. 18, one end of the external conveying section 19 is connected with an external output section 212 of the image printing device 12, and another end of the external conveying section 19 is connected with a printing medium receiving section 41 of the post-processing device 14.

As shown in FIG. 23, the post-processing device 14 includes a sort conveying section 44 which can selectively output the printing medium to an output tray 42 or an output tray 43. The sort conveying section 44 includes a plurality of rollers 45, a guide, and a conveyance direction switching guide 46. An output destination can be switched by controlling the conveyance direction switching guide 46. A user can select the output tray 42 or 43 as the output destination of the printing medium, and the printing mediums on which an image is formed can be output separately.

In addition to the above-described sorting processing, the post-processing can carry out the following post-processing: (i) a processing of stapling a predetermined number of printing mediums, (ii) a processing of folding a print sheet, such as a B4-size sheet and an A3-size sheet, and (iii) a processing of punching the printing medium(s) for filing.

Moreover, a wheel 48 is provided on a lower surface of the post-processing device 14, so that the post-processing device 14 can be moved easily.

Note that the configuration of the external conveying section 19 is not especially limited. The external conveying section 19 may be included in the post-processing device 14, and the external conveying section 19 and the image printing device 12 may be configured so as to be detachable. Moreover, the external conveying section 19, the post-processing device 14, and an image forming apparatus main body 20 may be configured so as to be detachable.

FIG. 19 is a diagram showing a configuration of the document image reading device 11. The document image reading device 11 can carry out (i) an automatic reading mode which automatically feeds a sheet-like document by an automatic document feeding device (ADF) and sequentially exposes and scans the documents one by one so as to read the document, and (ii) a manual reading mode which manually sets book-like documents or a sheet-like document, which cannot be fed automatically by ADF, to read the document(s).

An image of a document which is set automatically or manually on a transparent document reading table 49 (reading section) is formed on a photoelectric transducer by exposure and scanning, and the image is converted to an electric signal, and thus an image data is obtained. The obtained image data is output via a section connected with the image printing device 12.

When reading a two-sided document, it is possible to simultaneously scan and read document images on both sides of the document, in the process of conveying the document along a document conveying path.

When reading the lower surface of the document, a moving scanning-exposing optical system which scans the lower surface of a document table is so configured as to stop at a predetermined position of the document feeding path, guide an optical image to a CCD, and read a document image. Meanwhile, a contact image sensor (CIS) is provided for reading the upper surface of the document. The contact image sensor is configured integrally by, for example, (i) a light source, provided at an upper side of the document conveying path, for exposing the document, (ii) an optical lens for guiding the optical image to the photoelectric transducer, and (iii) the photoelectric transducer for converting the optical image into image data.

When reading of the two-sided document is selected, the document(s) placed in a document feeding section 111 is conveyed sequentially, and the images of both sides are read substantially simultaneously while the document(s) is conveyed.

The document tray 18 is attached to the document image reading device 11. The document tray 18 is used when feeding a document which is not read yet, or when receiving a document which has already been read. When feeding the document, the document which is not read yet is placed on the document tray, and an uptaking section of ADF takes up the document and conveys the document to the document reading table 49. The read document is output to the outside of the document image reading device 11 by the document output section. Meanwhile, when receiving the document, the document is placed on the document feeding section 111, and the uptaking section of ADF takes up the document and conveys the document to the document reading table 49. The read document is output to the document tray 18 by the document output section.

Figure 24:
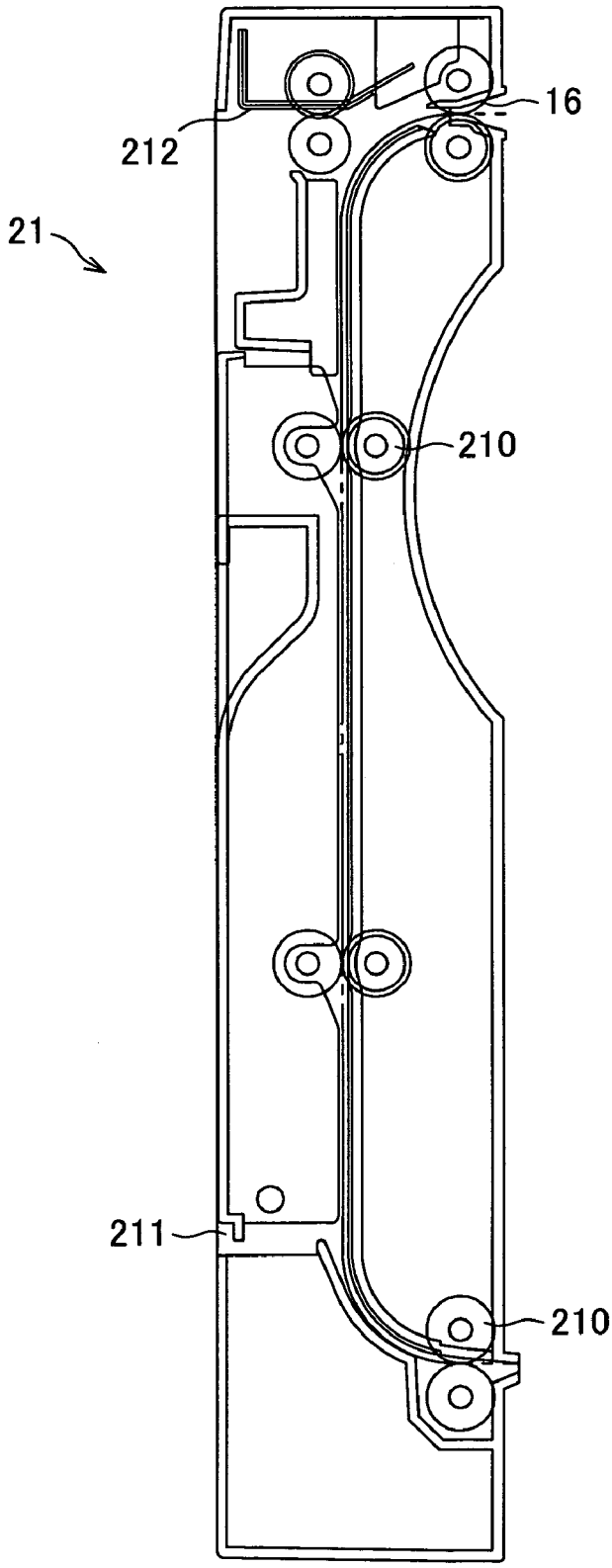
FIG. 24 is a diagram showing a configuration of a two-sided printing conveying section in the image forming apparatus.

FIG. 24 is a diagram showing a configuration of a two-sided printing conveying device 21. The two-sided printing conveying device 21 includes a two-sided printing conveying section, and the two-sided printing conveying section is attached to a left side surface of the image printing device 12 shown in FIG. 20(*a*).

The two-sided printing conveying section includes a plurality of rollers 210, and carries out a switchback conveyance of the printing medium, output from the fixing device 23, by using the printing medium output section 16 provided at an upper area of the image printing device. That is, the two-sided printing conveying section can turn over the printing medium, and again feed the printing medium toward a space between the photosensitive drum 22 and the transfer device 26 of the electrophotographic process section of the image printing device 12.

In the image forming apparatus 12, the switchback conveyance of the printed printing medium is carried out in the feeding path for outputting the printing medium toward the printing medium output section 16 provided at an upper area of the image printing device 12. In this way, it is possible to guide the printing medium to the post-processing device 14 shown in FIG. 23 and the two-sided printing conveying device 21 shown in FIG. 24.

In the fixing device 23, it is preferable that the cleaning means (cleaning roller 140) be provided downstream of a heated area by the external heating means (external heating roller 133).

According to the above-described configuration, the surface of the pressure roller 132 is cleaned after the surface of the pressure roller 132 is heated by the external heating roller 133. Therefore, the temperature of the toner adhered to the pressure roller is high when cleaning, so that the effect of cleaning by the cleaning roller 140 is improved. Even if the toner T adhered to the fixing roller 131 is again transferred to the surface of the pressure roller 132, the cleaning roller 140 provided downstream of the pressure roller 132 can clean the surface of the pressure roller 132. On this account, the printing sheet P is not contaminated.

Note that a sequence in the warm-up or a sequence when returning from the sleep mode to a state in which fixing can be carried out may include the following steps.

[1] a first step of turning on the heat source of the fixing roller 131 to increase the temperature of the fixing roller 131

[2] a second step of starting rotating the fixing device 23 after the fixing roller 131 reaches a predetermined temperature, so as to increase the temperature of the pressure roller by heat transmission from the fixing roller 131

[3] a third step of, after the fixing roller 131 returns to a control temperature, turning on the heat source of the pressure roller 132 and substantially simultaneously starting to feed the printing sheet(s) P Moreover, a sequence of the post-rotation carried out after finishing the sheet feeding may include the following steps.

[1] a first step of turning off the heat source of the fixing roller 131 to lower the temperature of the fixing roller 131

[2] a second step of idling the pressure roller 132 for a predetermined period of time while controlling the pressure roller to a predetermined temperature

[3] a third step of, after the above-described predetermined idling, turning off the heat source of the pressure roller 132, and stopping the idling As above, a fixing device of the present invention includes a first contacting member contacting a toner image surface and a second contacting member contacting a surface opposite to the toner image surface, and the fixing device fixes an unfixed toner image, formed on a printing medium, on the printing medium by causing the printing medium to pass through a contacting region (i) where the first contacting member and the second contacting member are in contact with each other and (ii) which is heated to a temperature at which fixing of toner is able to be carried out. Moreover, the fixing device of the present invention further includes: heating means for heating the first contacting member and the second contacting member; and control means for controlling the heating means so that a surface temperature of the second contacting member is in a temperature range defined by a cold offset occurring boundary temperature of the first contacting member and/or a hot offset occurring boundary temperature of the first contacting member.

Moreover, in the fixing device of the present invention, it is preferable that the control means control the heating means so that a formula below is satisfied, $$Tp \geqq 0.669Thc + 53.4$$

where Tp (° C.) is the surface temperature of the second contacting member, and Thc (° C.) is the cold offset occurring boundary temperature of the first contacting member.

Moreover, in the fixing device of the present invention, it is preferable that the control means control the heating means so that a formula below is satisfied, $$Tp \leqq 1.552Thh - Th$$

where Tp (° C.) is the surface temperature of the second contacting member, Th (° C.) is a surface temperature of the first contacting member, and Thh (° C.) is the hot offset occurring boundary temperature of the first contacting member.

Moreover, in the fixing device of the present invention, the control means controls the heating means so that a formula below is satisfied, $$0.669Thc + 53.4 \leqq Tp \leqq 1.552Thh - Th$$

where Tp (° C.) is the surface temperature of the second contacting member, Th (° C.) is a surface temperature of the first contacting member, Thc (° C.) is the cold offset occurring boundary temperature of the first contacting member, and Thh (° C.) is the hot offset occurring boundary temperature of the first contacting member.

Moreover, it is preferable that the fixing device of the present invention further include cleaning means for cleaning a surface of the second contacting member.

Moreover, in the fixing device of the present invention, it is preferable that the heating means include external heating means for directly heating a vicinity of a surface of the second contacting member.

Moreover, in the fixing device of the present invention, it is preferable that the external heating means be an external heating roller which contacts the surface of the second contacting member.

Moreover, in the fixing device of the present invention, it is preferable that the control means control a temperature of an external heating roller in accordance with a size of the printing medium.

Moreover, in the fixing device of the present invention, it is preferable that the external heating means be induction heating means for carrying out induction heating with respect to the vicinity of the surface of the second contacting member.

As above, the fixing device of the present invention includes: the heating means for heating the first contacting member and the second contacting member; and the control means for controlling the heating means so that the surface temperature of the second contacting member is in the temperature range defined by the cold offset occurring boundary temperature of the first contacting member and/or the hot offset occurring boundary temperature of the first contacting member.

Moreover, as above, in the fixing device, it is preferable that the control means control the heating means so that the formula below is satisfied, $$Tp \geqq 0.669Thc+53.4$$

where Tp (° C.) is the surface temperature of the second contacting member, and Thc (° C.) is the cold offset occurring boundary temperature of the first contacting member.

As the above-described configuration, the surface temperature of the second contacting member is controlled to a temperature equal to or higher than the above-described temperature (0.669Thc+53.4) determined by the cold offset occurring boundary temperature of the first contacting member. Thus, it is possible to suppress a transfer of toner, adhered to the back of the printing medium, to the second contacting member (a transfer of toner from the back of the printing medium).

Moreover, as above, in the fixing device, it is preferable that the control means control the heating means so that the formula below is satisfied, $$Tp \leqq 1.552Thh-Th$$

where Tp (° C.) is the surface temperature of the second contacting member, Th (° C.) is the surface temperature of the first contacting member, and Thh (° C.) is the hot offset occurring boundary temperature of the first contacting member.

As the above-described configuration, the surface temperature of the second contacting member is controlled to a temperature equal to or lower than the above-described temperature (1.552Thh−Th) determined by the hot offset occurring boundary temperature and the surface temperature of the first contacting member. Thus, it is possible to suppress a transfer of toner, adhered to the surface of the second contacting member, to the first contacting member (a transfer of toner from the second contacting member).

Moreover, as above, in the fixing device, it is preferable that the control means control the heating means so that the formula below is satisfied, $$0.669Thc+53.4 \leqq Tp \leqq 1.552Thh-Th$$

where Tp (° C.) is the surface temperature of the second contacting member, Th (° C.) is the surface temperature of the first contacting member, Thc (° C.) is the cold offset occurring boundary temperature of the first contacting member, and Thh (° C.) is the hot offset occurring boundary temperature of the first contacting member.

As the above-described configuration, the surface temperature of the second contacting member is controlled to be in a range determined by the cold offset occurring boundary temperature, the hot offset occurring boundary temperature, and the surface temperature of the first contacting member. Thus, it is possible to suppress both the transfer of toner from the back of the printing medium and the transfer of toner from the second contacting member.

Moreover, as above, it is preferable that the fixing device further include the cleaning means for cleaning the surface of the second contacting member.

According to the above-described configuration, the transfer of toner from the back of the printing medium to the second contacting member and/or the transfer of toner from the second contacting member to the first contacting member are suppressed, and the effect of cleaning can be obtained sufficiently by the cleaning means provided for the second contacting member, as described above. Therefore, it is unnecessary to provide cleaning means for the first contacting member. On this account, although it is conventionally necessary to provide cleaning means contacting the first contacting member (fixing roller) which needs to have a higher temperature than the second contacting member (pressure roller), this is unnecessary here, and it is therefore possible to shorten the warm-up time and reduce the power consumption.

Moreover, as above, in the fixing device, it is preferable that the heating means include the external heating means for directly heating the vicinity of the surface of the second contacting member.

According to the above-described configuration, as compared with a configuration in which the second heating member includes therein a heat source, it is possible to increase the surface temperature of the second contacting member more quickly, and also possible to control the surface temperature of the second contacting member more accurately.

Moreover, as above, in the fixing device, it is preferable that the external heating means be the external heating roller which contacts the surface of the second contacting member.

According to the above-described configuration, the heat at a portion, not contacting the printing medium, of the second contacting member moves to a portion, contacting the printing medium, of the second contacting member via the external heating roller (heat equalization).

Thus, it is possible to prevent too much temperature increase of the portion, not contacting the printing medium, of the second contacting member, and it becomes easy to control the temperature of the second contacting member to a predetermined temperature or lower.

Moreover, as above, in the fixing device, it is preferable that the control means control the temperature of the external heating roller in accordance with the size of the printing medium.

According to the above-described configuration, especially when the size of the printing medium is small, it is possible to prevent too much temperature increase of the portion, not contacting the printing medium, of the second contacting member, and it becomes easy to control the temperature of the second contacting member to a predetermined temperature or lower.

Moreover, as above, in the fixing device, it is preferable that the external heating means be the induction heating means for carrying out the induction heating with respect to the vicinity of the surface of the second contacting member.

According to the above-described configuration, it is possible to increase the surface temperature of the second contacting member effectively and more quickly, and also possible to control the surface temperature of the second contacting member more accurately.

Moreover, as above, a toner fixing method of the present invention includes, as steps of causing the first contacting member and the second contacting member to be such a state that fixing is able to be carried out, a first step of increasing a temperature of the first contacting member, and then increasing a temperature of the second contacting member by the first contacting member after the first contacting member reaches a first temperature that is lower than a predetermined temperature, and a second step of, after the first contacting member reaches a second temperature that is higher than the predetermined temperature, externally heating the second contacting member and substantially simultaneously starting to feed the printing medium to the contacting region.

Moreover, as above, a toner fixing method of the present invention includes, as steps of cleaning toner adhered to the first contacting member and the second contacting member after completing the fixing, a first step of lowering a temperature of the first contacting member, and a second step of maintaining a temperature of said external heating means to a temperature lower than a temperature of said external heating means when the printing medium passes through.

Moreover, an image forming apparatus includes: a photoreceptor on a surface of which an unfixed toner is formed; transfer means, contacting the photoreceptor, for transferring an unfixed toner image from the photoreceptor to a printing sheet; and fixing means for fixing the unfixed toner image transferred onto a printing medium by said transfer means, and the above-described fixing device may be used as said fixing means.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

The present invention can be widely utilized as a fixing device which is one of heating devices used in an electrophotographic device, such as a copier and a printer.

The invention claimed is:

1. A fixing device comprising a first contacting member contacting a toner image surface and a second contacting member contacting a surface opposite to the toner image surface, the fixing device fixing an unfixed toner image on a printing medium by causing the printing medium to pass through a contacting region (i) where the first contacting member and the second contacting member are in contact with each other and (ii) which is heated to a temperature at which fixing of toner is able to be carried out, the fixing device further comprising:

heating means for heating the first contacting member and the second contacting member; and control means for controlling said heating means so that a surface temperature of the second contacting member satisfies at least either of the following conditions (1) and (2), namely (1) the surface temperature of the second contacting member is not less than a lower temperature that is defined by a cold offset occurring boundary temperature of the first contacting member and (2) the surface temperature of the second contacting member is not more than an upper temperature that is defined by a hot offset occurring boundary temperature of the first contacting member, wherein the control means controls the surface temperature of the second contacting member so that the surface temperature of the second contacting member is lower than the surface temperature of the first contacting member.

2. The fixing device as set forth in claim 1, further comprising cleaning means for cleaning a surface of the second contacting member.

3. The fixing device as set forth in claim 1, wherein said heating means includes external heating means for directly heating a vicinity of a surface of the second contacting member.

4. The fixing device as set forth in claim 3, wherein said external heating means is an external heating roller which contacts the surface of the second contacting member.

5. The fixing device as set forth in claim 4, wherein the external heating roller is made of aluminum.

6. The fixing device as set forth in claim 3, wherein said control means controls a temperature of an external heating roller in accordance with a size of the printing medium.

7. The fixing device as set forth in claim 3, wherein said external heating means is induction heating means for carrying out induction heating with respect to the vicinity of the surface of the second contacting member.

8. The fixing device as set forth in claim 7, wherein said induction heating means is an induction coil which is so provided as to have a curvature and surround the second contacting member.

9. The fixing device as set forth in claim 7, wherein, on the surface of the second contacting member, a heat generating layer which generates heat by the induction heating is formed.

10. The fixing device as set forth in claim 9, wherein the heat generating layer has a thickness of 40 μm to 50 μm.

11. The fixing device as set forth in claim 9, wherein, on a surface of the heat generating layer, a release layer made of resin or an elastic body is formed.

12. An image forming apparatus comprising:

a photoreceptor on a surface of which an unfixed toner is formed;

transfer means, contacting the photoreceptor, for transferring an unfixed toner image from the photoreceptor to a printing medium; and fixing means for fixing the unfixed toner image transferred onto the printing medium by said transfer means, as said fixing means, the fixing device as set forth in claim 1 being used.

13. A fixing device comprising a first contacting member contacting a toner image surface and a second contacting member contacting a surface opposite to the toner image surface, the fixing device fixing an unfixed toner image on a printing medium by causing the printing medium to pass through a contacting region (i) where the first contacting member and the second contacting member are in contact with each other and (ii) which is heated to a temperature at which fixing of toner is able to be carried out, the fixing device further comprising:

heating means for heating the first contacting member and the second contacting member; and control means for controlling said heating means so that a surface temperature of the second contacting member is at a temperature in a range between a lower temperature that is defined by on a cold offset occurring boundary temperature of the first contacting member and an upper temperature that is defined by on a hot offset occurring boundary temperature of the first contacting member, wherein said control means controls said heating means so that a formula below is satisfied, $$Tp \geqq 0.669Thc + 53.4$$

where Tp (° C.) is the surface temperature of the second contacting member, and Thc (° C.) is the cold offset occurring boundary temperature of the first contacting member.

14. The fixing device as set forth in claim 13, wherein the cold offset occurring boundary temperature is between 120° C. and 130° C.

15. The fixing device as set forth in claim 14, wherein the cold offset occurring boundary temperature is 125° C.

16. A fixing device comprising a first contacting member contacting a toner image surface and a second contacting member contacting a surface opposite to the toner image surface, the fixing device fixing an unfixed toner image on a printing medium by causing the printing medium to pass through a contacting region (i) where the first contacting member and the second contacting member are in contact with each other and (ii) which is heated to a temperature at which fixing of toner is able to be carried out, the fixing device further comprising:

heating means for heating the first contacting member and the second contacting member; and control means for controlling said heating means so that a surface temperature of the second contacting member is at a temperature in a range between a lower temperature that is defined by a cold offset occurring boundary temperature of the first contacting member and an upper temperature that is defined by a hot offset occurring boundary temperature of the first contacting member, wherein said control means controls said heating means so that a formula below is satisfied, $$Tp \leqq 1.552Thh - Th$$

where Tp (° C.) is the surface temperature of the second contacting member, Th (° C.) is a surface temperature of the first contacting member, and Thh (° C.) is the hot offset occurring boundary temperature of the first contacting member.

17. The fixing device as set forth in claim 16, wherein the hot offset occurring boundary temperature is between 240° C. and 250° C.

18. The fixing device as set forth in claim 17, wherein the hot offset occurring boundary temperature is 245° C.

19. A fixing device comprising a first contacting member contacting a toner image surface and a second contacting member contacting a surface opposite to the toner image surface, the fixing device fixing an unfixed toner image on a printing medium by causing the printing medium to pass through a contacting region (i) where the first contacting member and the second contacting member are in contact with each other and (ii) which is heated to a temperature at which fixing of toner is able to be carried out, the fixing device further comprising:

heating means for heating the first contacting member and the second contacting member; and control means for controlling said heating means so that a surface temperature of the second contacting member is at a temperature in a range between a lower temperature that is defined by a cold offset occurring boundary temperature of the first contacting member and an upper temperature that is defined by a hot offset occurring boundary temperature of the first contacting member, wherein said control means controls said heating means so that a formula below is satisfied, $$0.669Thc + 53.4 \leqq Tp \leqq 1.552Thh - Th$$

where Tp (° C.) is the surface temperature of the second contacting member, Th (° C.) is a surface temperature of the first contacting member, Thc (° C.) is the cold offset occurring boundary temperature of the first contacting member, and Thh (° C.) is the hot offset occurring boundary temperature of the first contacting member.

20. A control method for controlling a fixing device so that the fixing device fixes an unfixed toner image on a printing medium by causing the printing medium to pass through a contacting region (i) where a first contacting member contacting a toner image surface and a second contacting member contacting a surface opposite to the toner image surface are in contact with each other and (ii) which is heated to a temperature at which fixing of toner is able to be carried out, the control method for controlling the fixing device so that an equation below is satisfied to prevent a transfer of toner, adhered to a back of the printing medium, to the second contacting member, $$Tp \geqq 0.669Thc + 53.4$$

where Tp (° C.) is a surface temperature of the second contacting member, and Thc (° C.) is a cold offset occurring boundary temperature of the first contacting member.

21. A control method for controlling a fixing device so that the fixing device fixes an unfixed toner image on a printing medium by causing the printing medium to pass through a contacting region (i) where a first contacting member contacting a toner image surface and a second contacting member contacting a surface opposite to the toner image surface are in contact with each other and (ii) which is heated to a temperature at which fixing of toner is able to be carried out, the control method for controlling the fixing device so that an equation below is satisfied to prevent a transfer of toner, adhered to the second contacting member, to the first contacting member, $$Tp \leqq 1.552Thh - Th$$

where Tp (° C.) is a surface temperature of the second contacting member, Thh (° C.) is a hot offset occurring boundary temperature of the first contacting member, and Th (° C.) is a surface temperature of the first contacting member.

22. A control method for controlling a fixing device so that the fixing device fixes an unfixed toner image on a printing medium by causing the printing medium to pass through a contacting region (i) where a first contacting member contacting a toner image surface and a second contacting member contacting a surface opposite to the toner image surface are in contact with each other and (ii) which is heated to a temperature at which fixing of toner is able to be carried out, the control method for controlling the fixing device so that an equation below is satisfied to prevent (a) a transfer of toner, adhered to a back of the printing medium, to the second contacting member and (b) a transfer of toner, adhered to the second contacting member, to the first contacting member, $$0.669Thc + 53.4 \leqq Tp \leqq 1.552Thh - Th$$

where Thc (° C.) is a cold offset occurring boundary temperature of the first contacting member, Tp (° C.) is a surface temperature of the second contacting member, Thh (° C.) is a hot offset occurring boundary temperature of the first contacting member, and Th (° C.) is a surface temperature of the first contacting member.

* * * * *